US006583535B1

(12) United States Patent
Lumpp

(10) Patent No.: US 6,583,535 B1
(45) Date of Patent: Jun. 24, 2003

(54) TUBE, WITH BORE HAVING CONVEX SIDES, FOR EMITTING ELECTROMAGNETIC RADIATION, AND METHOD THEREOF

(76) Inventor: Christian Lumpp, 7, Impasse des Aravis, Les Pérouses, F-74150 Rumilly (FR)

( * ) Notice: Subject to any disclaimer, the term of this patent is extended or adjusted under 35 U.S.C. 154(b) by 0 days.

(21) Appl. No.: 09/582,038

(22) PCT Filed: Jan. 15, 1999

(86) PCT No.: PCT/FR99/00074

§ 371 (c)(1),
(2), (4) Date: Jun. 21, 2000

(87) PCT Pub. No.: WO99/36939

PCT Pub. Date: Jul. 22, 1999

(30) Foreign Application Priority Data

Jan. 15, 1998 (FR) ..... 98 00382

(51) Int. Cl.[7] ..... H01J 5/16; H01J 61/33

(52) U.S. Cl. ..... 313/110; 313/113; 313/493; 313/634; 250/504 R; 362/268

(58) Field of Search ..... 313/110, 113; 250/504 R; 362/268

(56) References Cited

U.S. PATENT DOCUMENTS

| | | | | |
|---|---|---|---|---|
| 2,254,962 A | | 9/1941 | Harris et al. | |
| 2,356,654 A | * | 8/1944 | Cullman | 362/223 |
| 3,885,181 A | * | 5/1975 | Nelson et al. | 220/2.1 R |
| 4,596,935 A | * | 6/1986 | Lumpp | 250/495.1 |
| 5,673,998 A | | 10/1997 | Inoue | |
| 5,712,487 A | * | 1/1998 | Adachi et al. | 250/492.1 |
| 5,813,743 A | * | 9/1998 | Naka | 362/16 |

FOREIGN PATENT DOCUMENTS

| | | |
|---|---|---|
| JP | 0 198 088 A | 10/1986 |
| WO | WO 98 01700 A | 1/1998 |

* cited by examiner

*Primary Examiner*—Michael H. Day
*Assistant Examiner*—Matt Hodges
(74) *Attorney, Agent, or Firm*—Oliff & Berridge, PLC

(57) ABSTRACT

The invention relates to a tube emitting electromagnetic radiation which is made of glass or transparent non-fluorescent quartz, and has an elongated boring able to house a radiation-emitting filament or bundle. The boring has a substantially square or rectangular cross-section, at least two opposite sides of which form dioptric convex surfaces shaped to alter the direction of the radiation emitted by the filament or axis of the bundle so as to render them parallel or substantially parallel in the solid transparent glass medium.

30 Claims, 19 Drawing Sheets

TUBE, WITH BORE HAVING CONVEX SIDES, FOR EMITTING ELECTROMAGNETIC RADIATION, AND METHOD THEREOF

BACKGROUND OF THE INVENTION

The present invention relates to a tube emitting electromagnetic radiation, made of a transparent non-fluorescent material, in particular a glass-based or quartz-based material, and having a straight structure drilled from end to end by a bore elongate around an axis so as to confine a housing designed to contain a radiation-emitting filament or plasma bundle.

It also relates to a device and a method implementing such a tube.

The invention finds a particularly important, although non-exclusive, application in the field of photochemical treatment of materials by ultraviolet radiation with emitting tubes containing an ionized gas, the pressure of which gas depends on the concentration of plasma inside the tube, used for example in the sterilization field, the paper industry, textiles, the wood and plastic materials industry, the food industry, the automobile industry and the printing field, in particular for polymerization of inks or varnishes on films, for example formed by supports in the form of reels of paper or cardboard, or supports made of metallic material such as aluminium or copper foil or steel strip, or supports made from synthetic material such as plastic products, PVC, polyethylene or other, or supports made of natural, recomposed or synthetic wood, or even electronic circuitry or any other support.

Another application is in the infrared field.

The invention is not limited to the types of products to be treated. It can for example be used for drying of products in plate form, for drying of certain varnishes and adhesives, for drying of wire-based products extending elongate around an axis, or for sterilization of liquid products in the form of a sheet or of a column around an axis.

STATE OF THE PRIOR ART

Glass tubes emitting ultraviolet or infrared rays comprising a cylindrical bore are already known. These tubes in general associated to concave reflectors of parabolic or elliptic cross sections present drawbacks. They present large dimensions, are cumbersome and are not of optimum efficiency.

Most devices of the prior art in fact essentially describe separate emitters/reflectors implementing a distribution of the radiation emitted by a bundle or a filament according to two embodiments, i.e. primary rays which are emitted from the source in a divergent flux, and secondary rays which, being emitted from the source, are reflected on a surface presenting a cross section in the form of a mathematical curve to reach the irradiated plane in a convergent or parallel flux.

In all cases, and by structural defect of the system, the primary rays therefore do not have the same optimized trajectory, and consequently the same efficiency, as the secondary rays.

The document U.S. Pat. No. 3,885,181 describes a high-pressure sodium lighting lamp designed to emit rays in the visible field. It comprises a tubular discharge enclosure, made of an alumina-charged polycrystalline material. It has a non-circular cross section for an asymmetric polar distribution of the light emitted by the lamp. The emitting source is diffused from a luminous surface, and its plasma section is imposed by the internal geometry of the enclosure. The radiating source is not pin-point and the lamp is not equipped with a reflector or a monoblock emitter/reflector. Such a lamp is used for public lighting or for traffic signals.

The document U.S. Pat. No. 2,254,962 relates to an optic device composed of a cylindrical lens having a central refraction surface and a reflector with additional elliptic reflection and refraction surfaces of the same virtual focal spot. The light source is distinct and is housed in a semi-open notch, being dissociated from the reflector, which cannot restitute the whole of the radiation. The walls of the notch are arranged in such a way as to obtain divergent fluxes in the lens when passing the dioptric planes formed by the edges forming the confines of the notch. Such a device does not constitute a longitudinal monoblock emitter/reflector able to recover the whole of the emitted radiation over 360°.

OBJECT OF THE INVENTION

The object of the present invention is to provide a radiation-emitting tube, a device and a method implementing such a tube, meeting the requirements of practice better than those known in the prior art.

A first object of the invention is to achieve a compact tube which is not cumbersome, able to render the primary and secondary rays homogeneous, complementary, and directed in the same direction towards the irradiated product, in order to optimize the usable photochemical, photothermal and/or photoluminous radiating energy.

A second object of the invention consists in recovering the whole of the spatial radiation emitted by an electromagnetic emitting tube to increase the focusing and the energy efficiency.

The invention stems from the idea of giving the bore an appreciably square or rectangular cross section, at least two opposite sides of which are of a cross section in the form of a convex curve, so as to obtain parallel fluxes when passing the dioptric planes formed by said sides.

What must be understood here by convex is an internal convex curve whose peak is directed towards the axis of the bore.

What must be understood here by appreciably square or rectangular is a four-sided figure inscribed in a square or a rectangle, said sides being in an arc of a circle with large radii of curvature, i.e. for example R>10 mm.

To do this the centre of the plasma bundle, or the irradiating filament, is arranged to be at the centre of the geometric optics of said dioptric surfaces.

Thus the convex dioptric surfaces of the bore modify the divergent radiating flux from the geometric centre of the convex curves to form a flux which is parallel or appreciably parallel, in the transparent solid medium, then parallel or even convergent towards the plane to be irradiated, in combination with the dioptric output surface of the tube and/or a reflecting surface of the emitted rays situated on the side walls, on each side, for example symmetrically with respect to the axial plane of the bore.

The tube according to the invention is characterized in that the bore is of appreciably square or rectangular shaped cross section at least two opposite sides of which are in the shape of convex curves, said sides forming dioptric surfaces arranged to modify the direction of the rays emitted from the filament or from the axis of the emitting bundle to make them parallel or appreciably parallel in the transparent solid medium of the glass.

By obtaining parallel rays in the transparent medium, subsequent treatment of the rays is rendered considerably easier. Proliferation of the rays is also reduced achieving in particular an excellent power density in the case of focusing, and enabling limiting of the divergent rays to be achieved in the case of parallel flux irradiation.

In an advantageous case, the sides of the bore are respectively symmetrical with respect to the planes of symmetry of the square or of the rectangle, the direction of the rays being appreciably parallel to that of a plane of symmetry of the square or of the rectangle of the bore.

In the embodiments more particularly described, the present invention implements a straight emitting tube whose geometric centre of emission is merged with and identical to the focal spot of a corresponding reflector, which is also straight and of at least partially flat or appreciably flat cross section to treat flat surfaces, or of at least partially inverted parabolic cross section to focus the radiation, the generating line at the peak of the curve of the reflector being parallel to the axis which is merged with and identical to the focal line, and the end edges of the straight or inverted parabolic portions being situated below the axis of the bore, on the other side of the latter with respect to said generating line at the peak.

By inverted parabola we mean the reflection curve which transforms the parallel flux into a convergent flux focused on a line.

More precisely the ultraviolet, and/or visible, and/or infrared radiation emitters of the invention more particularly described here are tubes comprising electrodes at very high temperature (greater than 1000° C.) called hot electrodes generating a plasma arc with continuous or discontinuous photon emission.

The electric arc generated by the two electrodes, respectively situated on each side of the transparent non-fluorescent tube, generates a luminous cylinder of constant cross section generally formed by one or more metallic iodides in the plasma state, or by xenon or a mercury/xenon mixture or other gases or rare earths.

The luminous cylinder presents a total length constituted by the distance between the two electrodes, for example comprised between a few mm for short arc emitters and more generally between 30 mm and 2500 mm, or even several meters, for example ten or fifteen meters, and also presents a cross section of the luminous zone with high plasma concentration smaller than the internal cross section of the transparent tube which contains it.

A voltage between electrodes comprised between 20 volts/cm and 150 volts/cm, for example 30 volts/cm or 100 volts/cm results in fact in an extremely reduced appreciably cylindrical bundle cross section forming a luminous pencil beam appearing as being completely away from the walls of the bore, creating a space of a relative vacuum which generates a reduced pressure appreciably equal to atmospheric pressure at the level of the internal wall of the cylindrical tube or of the monoblock emitter/reflector tube.

Moreover, the plasma concentration fosters an electronic and plasmatic gaseous vacuum in the vicinity of the internal walls which slows down the heat transfer to the outside, resulting in colder enclosure walls.

The metallic iodide(s) can originate from pure metals or alloys that is to say and for example a pure mercury, a pure iron, a pure gallium, an iron/cobalt (mixture), a gallium/lead (mixture), a mercury/gallium (mixture), etc.

The gas(es) used can be pure (for example xenon) or in mixture form (for example mercury/xenon), subjected as is known to frequencies other than 50 Hz, either of alternating current or of pulsed current or not, of constant polarity and variable intensity.

The list of mixtures of metals, rare earths and/or gases mentioned above is naturally not exhaustive. Moreover their respective proportions, and the choice of frequency, pulsing or modulation, are determined according to the specific wavelengths of the rays.

In advantageous embodiments recourse is more or less had to one and/or the other of the following arrangements:

- the sides of the bore are arranged to form dioptric surfaces so as, in combination with the output dioptric surface of the tube or with a reflecting surface associated with the output dioptric surface of the tube, to direct the rays in a parallel or convergent flux towards a surface or a line to be irradiated;
- the four sides of the bore are of convex shape, for example the opposite sides being identical two by two;
- the convex shape of the internal walls of the bore is a portion of a circle whose radius of curvature is determined by a conventional calculation of the radius of curvature of thick biconvex lenses. For example, the radius of the circle R1 of value 10 mm is, for a distance from the opposite convex surfaces of 12.6 mm to focus the rays at the virtual focal spot F', at a distance of 50 mm from the external surface of the bottom wall.
- the tube comprises an upper external wall, called the upper face, of external surface arranged to reflect the emitted rays back towards the axis of the bore, said external wall being covered with a reflecting material to function in a form called inverted radiation.

The external surface is symmetrical with respect to the longitudinal axial plane of the bore, vertical or perpendicular to the plane to be irradiated, and for example in an arc of a circle or flat;

- the tube comprises a reflecting surface securedly united to said tube;
- it comprises a reflecting surface for reflection of the emitted rays situated on one side of said tube, a surface comprising two longitudinal side wings symmetrical with respect to an axial plane of the bore, the portion of dioptric or metallic reflecting surface of said side wings being inscribed in a surface of straight or inverted parabolic or appreciably straight or inverted parabolic cross section;
- the reflecting surface is formed at least partly by the internal faces of the wings, by dioptric refraction;
- the reflecting surface is formed at least partly by a reflecting material;
- the tube comprises a bottom external face joining the wings, situated on the opposite side from the generating line at the peak of the tube with respect to the bore.

The face is convex at the centre and appreciably straight at the ends, according to a curve symmetrical with respect to the axial plane containing the generating line at the peak, so as to direct the emitted rays towards a focalization line situated on the irradiation plane.

In the case where the reflecting surface is formed at least partly by two planes symmetrical with respect to the vertical axial plane of the bore, the generating line is replaced by the intersecting line of the flat faces inscribed in a "chinese hat" whose upper edge is said intersecting line;

- the tube is symmetrical with respect to an axial plane of the bore parallel to the irradiation plane;

the irradiation plane is in general a surface perpendicular to the longitudinal axial plane of symmetry of the tube;

the external wall, or upper face, of the tube is partially cylindrical on the side where the generating line at the peak of the tube is located between the external faces of the side wings;

the upper face of the tube is truncated forming a flat external face between the external faces of the side wings;

the tube is of appreciably cylindrical shape and comprises two added-on glass wings symmetrical or not with respect to the axial plane of the bore perpendicular to the irradiation plane.

In this case, the tube and wings are adjoined, for example simply in contact, or stuck together by a synthetic or ceramic glue, or welded by melting of the quartz, or mechanically fixed to one another;

the bore is formed by four radially distributed glass quarters adjoined via their ends and engaging in a peripheral glass cylinder or a cylindrical bore made in the tube;

the tube comprises a second, cylindrical, tube internal to the bore and designed to contain the plasma bundle and/or containing an emitting filament;

the space between the external tube and the internal tube, adjoined or not to the external tube, can be favourably used for flow of a gaseous or liquid coolant;

the second, cylindrical, tube can be in contact with the generating line at the peak of the convex internal surfaces;

the cylindrical second tube may not be in contact with the convex internal surfaces in so far as the buoyancy created by the internal space of the enclosure bathing in a liquid medium is equal or appreciably equal to the weight of the enclosure, the cylindrical second tube, supported at both ends, then centring itself over its whole length;

the bore comprises an upper surface of concave cross section.

In other words, the top side of the cross section of the bore is concave, i.e. presenting a radius of curvature whose centre is situated on the side of the bore or the peak in the opposite direction to the latter;

the bore is arranged to contain a gas normally ionized under medium or high pressure, the emitted rays being ultraviolet, and/or visible, and/or infrared rays.

By medium or high pressure we mean absolute gas pressures greater than 2 kg/cm$^2$, for example 3 kg/cm$^2$ for a medium pressure and greater than 5 kg/cm$^2$ for a high pressure, able for example to go up to 15 kg/cm$^2$.

the tube comprises electrode chambers of internal section greater than or equal to the internal section of the radiating emitting part of the tube;

the tube comprises an infrared radiation-emitting filament.

A third object of the invention is to achieve an emitter/reflector device implementing one or more tubes as described previously.

Advantageously the device comprises, situated at the focal plane of concentration of the emitted rays, a blade with parallel or appreciably parallel side faces in the form of a funnel, comprising a dioptric radiation input surface able to transform the convergent rays received into a parallel radiation flux.

In an advantageous embodiment, the device comprises reflecting surfaces separated from the tube and constituted by reflecting plates able to be advantageously flat.

A fourth object of the invention also relates to a method for application of rays to a product in sheet form or disposed on a flat or curved surface. It consists in irradiating the product with a radiation-emitting element (plasma bundle or electric filament) presenting a very small cylindrical or appreciably cylindrical cross section, i.e. with a diameter smaller than about 10 mm, for example of about 4 mm, about 2 mm, or even down to 1 mm, and even 0.5 mm (by 'about', it must be understood ±1 mm and/or 10 to 15%), centred in the bore of a straight glass tube elongate around an axis, said bore being of appreciably square or rectangular shaped cross section at least two opposite sides of which are in the form of convex curves, said sides forming dioptric surfaces arranged to modify the direction of the rays emitted from the axis of the bore to make them parallel or appreciably parallel in the transparent solid medium of the glass, before being diverted to the product by metallic or dioptric reflecting surfaces.

In an advantageous embodiment, the bore comprises four convex sides, the opposite sides being identical two by two.

Advantageously, the emitting element is a tubular plasma bundle emitting ultraviolet and/or visible and/or infrared photon rays.

The tubular plasma bundle of ultraviolet rays preferably has a cross section presenting a maximum radial dimension smaller than or equal to about 4 mm.

The emitting element can be formed by an electric filament, emitting infrared rays.

In an advantageous embodiment, two irradiation planes situated symmetrically on each side of said emitting tube are irradiated with a single tube.

BRIEF DESCRIPTION OF THE DRAWINGS

The invention will be better understood on reading of the following description of several embodiments given as non-restrictive examples.

The description refers to the accompanying drawings in which.

In the description which follows, the same reference numbers will preferably be used to designate elements which are identical or of the same type.

DETAILED DESCRIPTION OF VARIOUS PREFERRED EMBODIMENTS OF THE INVENTION

Figure 1:
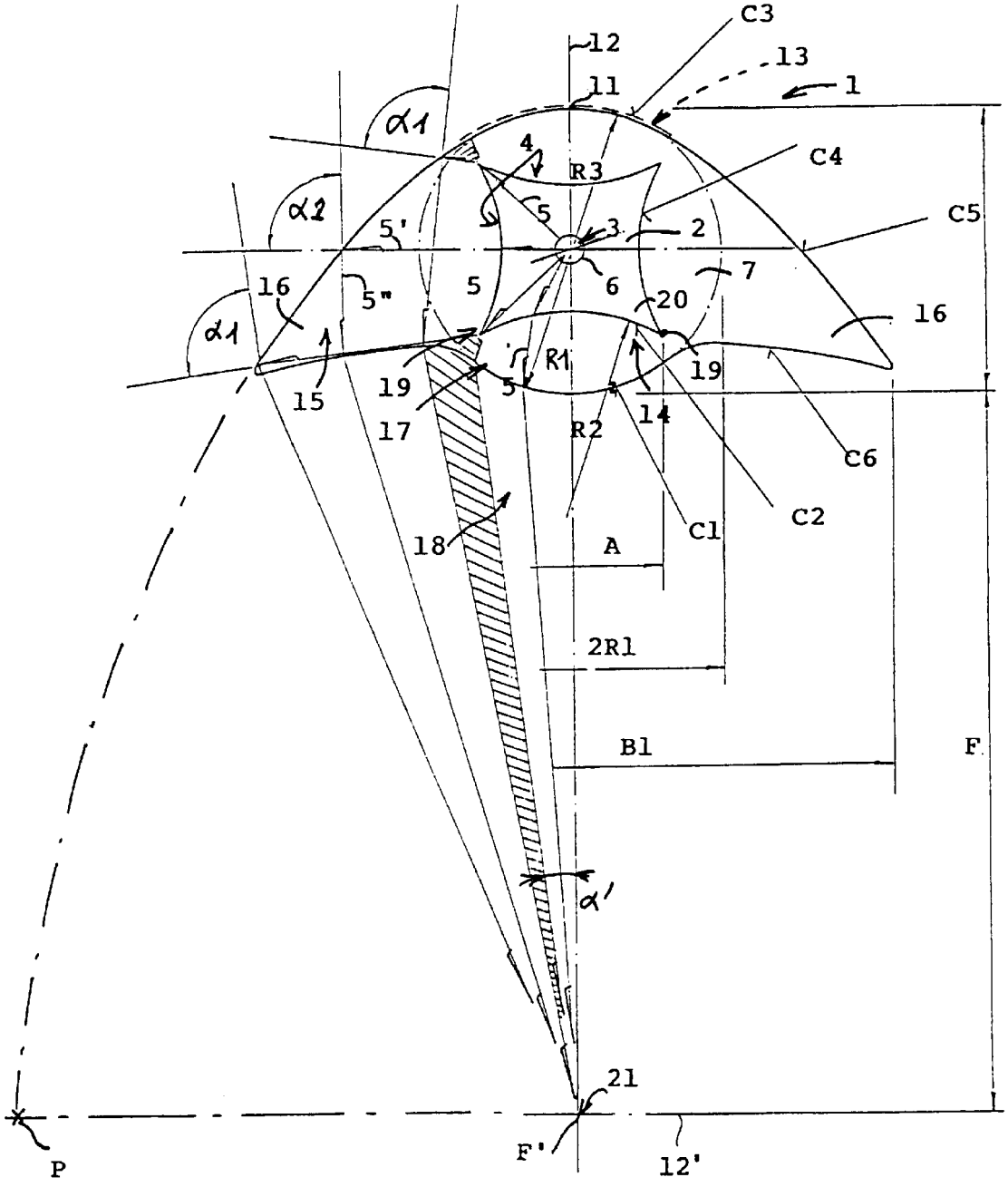
FIGS. 1 and 2 are cross sectional views of two alternative versions of a first embodiment of a monoblock emitter/reflector tube according to the invention, comprising an upper surface forming the reflecting surface and comprising two lateral portions presenting an inverted parabolic or appreciably inverted parabolic cross section.
Figure 2:
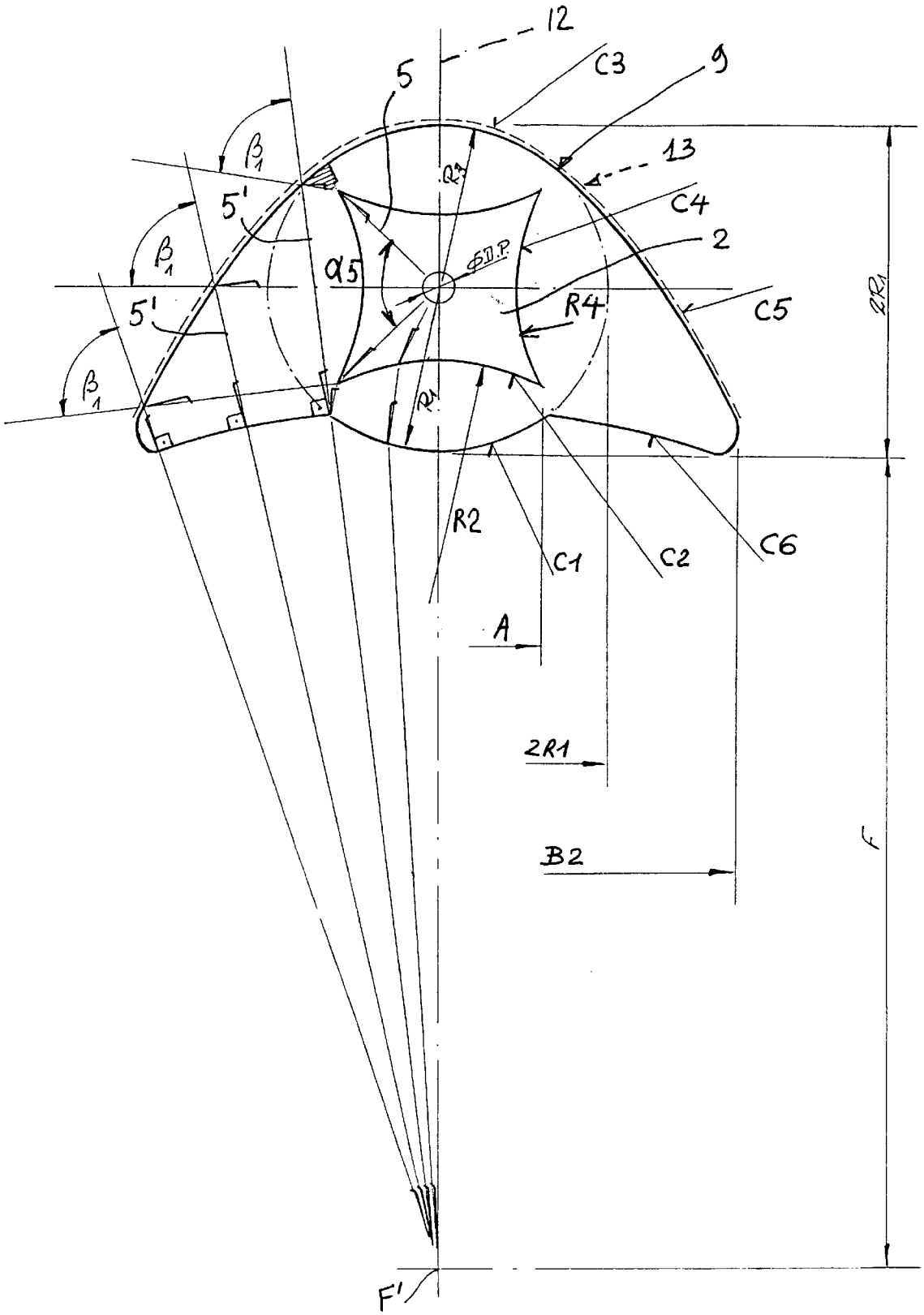

FIGS. 1 and 2 show, in cross section, a straight glass tube 1, for example made of extruded quartz.

The tube 1 is drilled from end to end by a bore 2, obtained for example by extrusion.

The bore is elongate around an axis 3, of appreciably square cross section, whose four sides 4 identical two by two are in the shape of a convex curve (C2, C4), i.e. in the form of a portion of a circle of radius R2 and R4 whose centre is situated outside the bore, with R4>R2, for example R4=1.2 R2.

The sides 4 form dioptric surfaces which modify the direction of the rays 5 emitted from the axis 3 or appreciably from the axis 3, for example by the plasma bundle or the infrared filament having the same axis as the axis 3 and represented by 6 in the figures, to make them parallel or appreciably parallel (rays 5') in the solid transparent medium 7 of the glass.

In the embodiment of an ultraviolet radiation emitter, the tube is closed at both ends by electrode-bearing plugs (not represented), and contains an ionized gas, for example an iodide, or mercury, or xenon, or krypton, able to emit rays 5 which are either ultraviolet or infrared or essentially in the visible light spectrum, when the tube is powered and creates a plasma arc between the electrodes, in a manner known in itself.

The tube 1 comprises an upper external wall 8', called the upper face, of external surface 9 of at least partly inverted parabolic cross section, of equation $y=x^2/4f$, f being the focal distance of the parabola between the focal spot 21, which is merged with and identical to the irradiated point F' situated on the axial plane of symmetry 12 of the bore, and the peak P of the parabola which is the extension of the vertically arranged side wall or the intersection with the horizontal focal axis of F' and which makes the focal distance PF' in such a way that PF'=f.

According to the embodiment of the invention of FIG. 1, the surface 9 of the cylindrical part C3 of the central portion 11, symmetrical with respect to the plane 12, is covered, for example by cathode sputtering in a vacuum or by any other means known to those specialized in the trade enabling adhesion on quartz, by a film 13 (in broken line in FIG. 1) of material reflecting the ultraviolet (U.V.) rays emitted, for example formed by a metallic layer of aluminium of a thickness of about one micron, for U.V. of a wavelength ranging from 100 nm to 500 nm, for example 360 nm. This same reflecting material can be used for radiating emissions in the visible or infrared spectrum. For these wavelengths, the reflecting aluminium layer can advantageously be replaced by a gold or silver or enamel reflecting layer.

The tube 1 is closed on the other side of the portion 11 in relation to the bore 2 by a solid wall 14 extending between the ends 15 of the solid side wings 16 formed by the inverted parabolic sections symmetrical with respect to the axial plane 12.

The wall 14 comprises an external face 17, transparent to radiation, for passage of the directly emitted rays 5' or of the rays 5" reflected by the inverted parabola.

It is recalled here, as a reminder:

that the (total or almost total) radiating energy which irradiates from the focal spot 21 of emission is constituted by the sum of two radiating energies, comprising the primary radiating energy, which irradiates directly in a closed prismatic space 18, with an angle at the peak ∞'. For example 7°, and whose limits are appreciably the ends 19 of the side tips forming acute angles for example of less than 40°, for example comprised between 35° and 10°, of the bore 2, and the secondary radiating energy, which irradiates in appreciably parallel manner on the reflection curve of the reflector to be reflected therein and return to the external joining face 17 between the ends of the wings towards the product situated in the irradiated plane 12' perpendicular to the axial plane 12, that the energy efficiency of a divergent beam depends on the distance it covers from its point of emission to its point of receipt; by shortening this distance from the point of emission to the reflection plane on the one hand, and from the reflection plane to the irradiated product on the other hand, the invention therefore optimizes the efficiency, that a better penetration of the product to be irradiated depends on a high radiating power density.

The intensity radiated in any direction is equal to the product of the intensity radiated in the direction of the normal to the irradiated surface by the cosine of the angle which this direction makes with the normal to the irradiated plane (Lambert's cosine law).

The external face 17 of FIGS. 1 and 2 is convex at the centre according to a curve C1 forming a portion of cylinder of radius R1 and appreciably straight C6 towards the ends, from or appreciably from the point of the curve C1 situated in the extension of the radius passing via the end 19 of the lateral points 20 of the bore situated on the side where the plane to be irradiated is located.

In the embodiments more particularly described here, the emitter/reflector device is a monoblock entity, made of extruded quartz glass material, of very high transparency quality in the 180 nm to 2000 nm passband and with a very low fluorescence level, in which the emitter and its reflector are intimately linked, inseparably merged and indissociable.

The other part, facing the irradiated product, is transparent and arranged to direct the whole of the transmitted rays to the product, in such a way that the whole or the essential part of the primary and secondary rays with parallel or appreciably parallel fluxes is directed perpendicularly to the irradiated product, according to Lambert's law, or in the direction of the axial plane 12 towards the focal spot F' of the inverted parabola in the focused case.

The geometrical shape of the dioptric surfaces of the sides of the bore implemented and generated structurally within the scope of the embodiments of the invention more particularly described here is designed with reference to the geometrical focal spot of the device comprising a tube according to the invention, a focal spot which is in general merged with and identical to the axis of the bore, which will therefore hereinafter be called the focal axis.

Thus any light point originating from the focal axis irradiates radially as subsequently represented in the figures.

On the other hand, it can be noted that any light point of the bundle situated outside the focal axis is only partially in accordance with this radial irradiation mode corresponding to the design of the dioptric surfaces. Only the rays originating in the plane passing through the focal axis correspond to this design.

By greatly concentrating the plasma bundle emitting photon radiation, or with a filament emitting infrared radiation, and with the shape of the bore according to the invention, the whole of the emitting light flux is practically or appreciably practically concentrated on the focal axis, which enables considerably improved results to be obtained with respect to the prior art, for example the light density is multiplied by ten compared with the prior art.

In the case of FIG. 1 the rays passing through the transparent solid medium 5' are appreciably parallel and are reflected on a curve with dioptric reflection C5, in which the angle $\alpha_1$ of incidence/reflection of the rays 5 is $\geqq 2\times 42°$, with as hypothesis the wavelength $\lambda$=360 nm, which determines a limit angle of incidence $\alpha_L$ of dioptric refraction.

It can be noted that the primary rays 5 and secondary rays 5' which pass through the dioptric curves C1, facing the bottom side of the square bore, and C6 are refracted (and therefore diverted) to be completely focused at the virtual focal spot F' on the plane 21.

FIG. 2 shows a tube 1 comprising a bore 2 and a cross section similar to those described with reference to FIG. 1. Only the angle of incidence/reflection of the rays 5, $\beta 1<2\times 42°$ is different here, requiring the external surface 9 to be covered with a reflecting layer 13, for example obtained by metallization of the whole reflection curve represented in unbroken lines by C3 and C5.

It can also be noted that the dioptric curve C6 of the external face 17 of the bottom wall 14, unlike that of FIG. 1, is here at all points perpendicular to the secondary rays 5' which pass through it (the radiation is therefore not diverted) to locate, with the primary radiation passing through the curve C1, the virtual focal spot F'.

Figure 3:
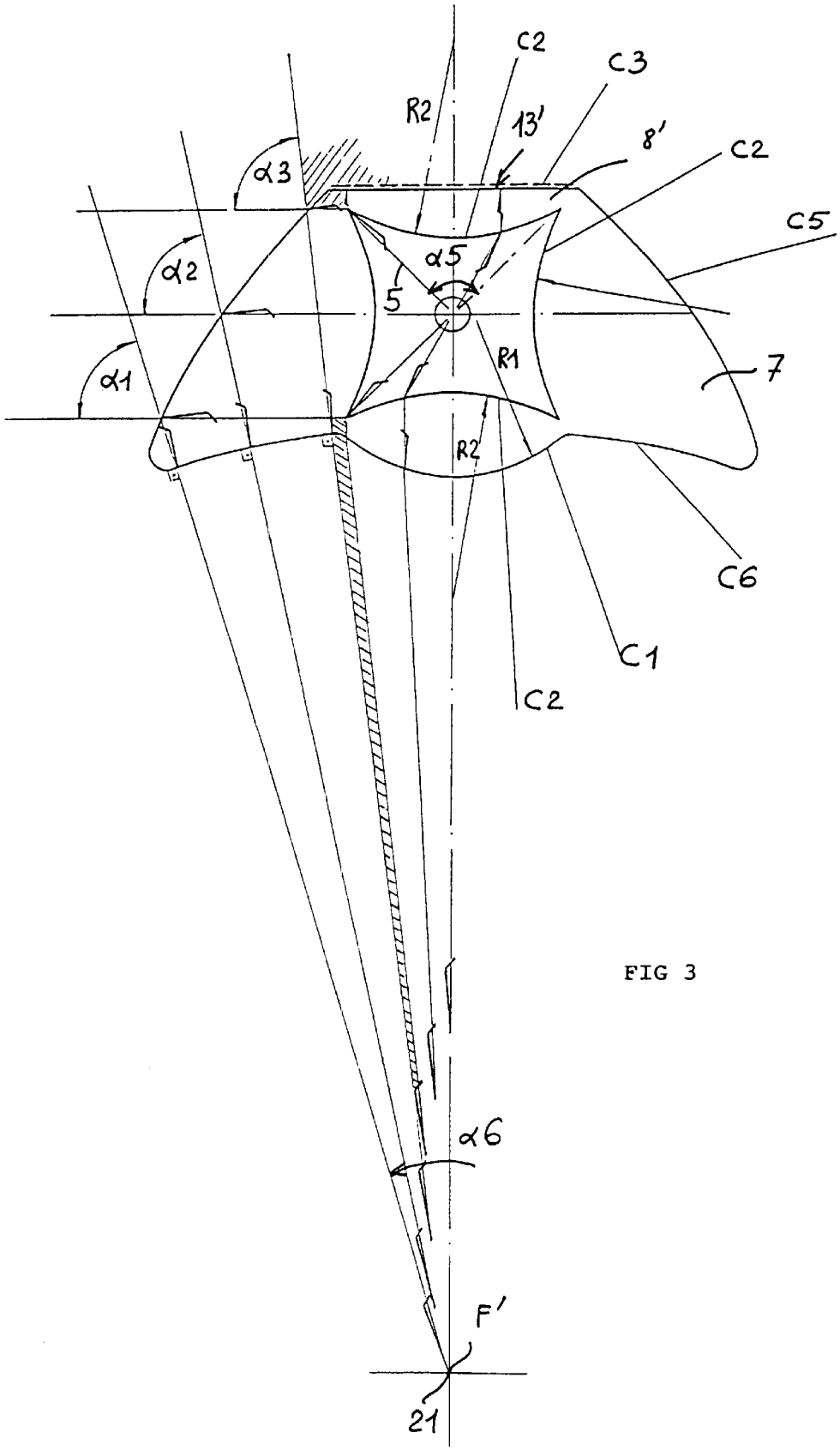
FIGS. 3 and 4 are cross sectional views of two other alternative versions of the monoblock tube according to the invention with a truncated, flat upper portion of the tube covered with a reflecting material.

FIG. 3 shows an alternative embodiment of FIG. 2 with the upper face 8' of the tube truncated by a horizontal flat surface C3 covered with a reflecting film 13' represented in unbroken lines.

The rays 5 pass through the transparent solid medium 7, in a strictly parallel flux, and meet an inverted parabolic dioptric reflection curve C5 in which the angles of incidence/reflection of the rays 5 are such that $\alpha 3>\alpha 1\geqq 2\times 42°$.

It can be noted here that the metallic reflection curve C3 of flat shape is in accordance with the inverted light image. Let us recall that the limit angle of refraction $\alpha_L$ taken here as being equal to 42° is dependent on the wavelength used.

Thus the secondary radiating energy originating from the inscribed angle $\alpha 5$ is added to the primary radiating energy inscribed in the angle of re-emission of the radiation towards the focal spot F' inside which the rays are all directed to the plane 21 situated at the front of the emitter/reflector.

At this level, all the radiating energy normally inscribed over 360° is therefore contained in the angle $\alpha 6$.

Figure 4:
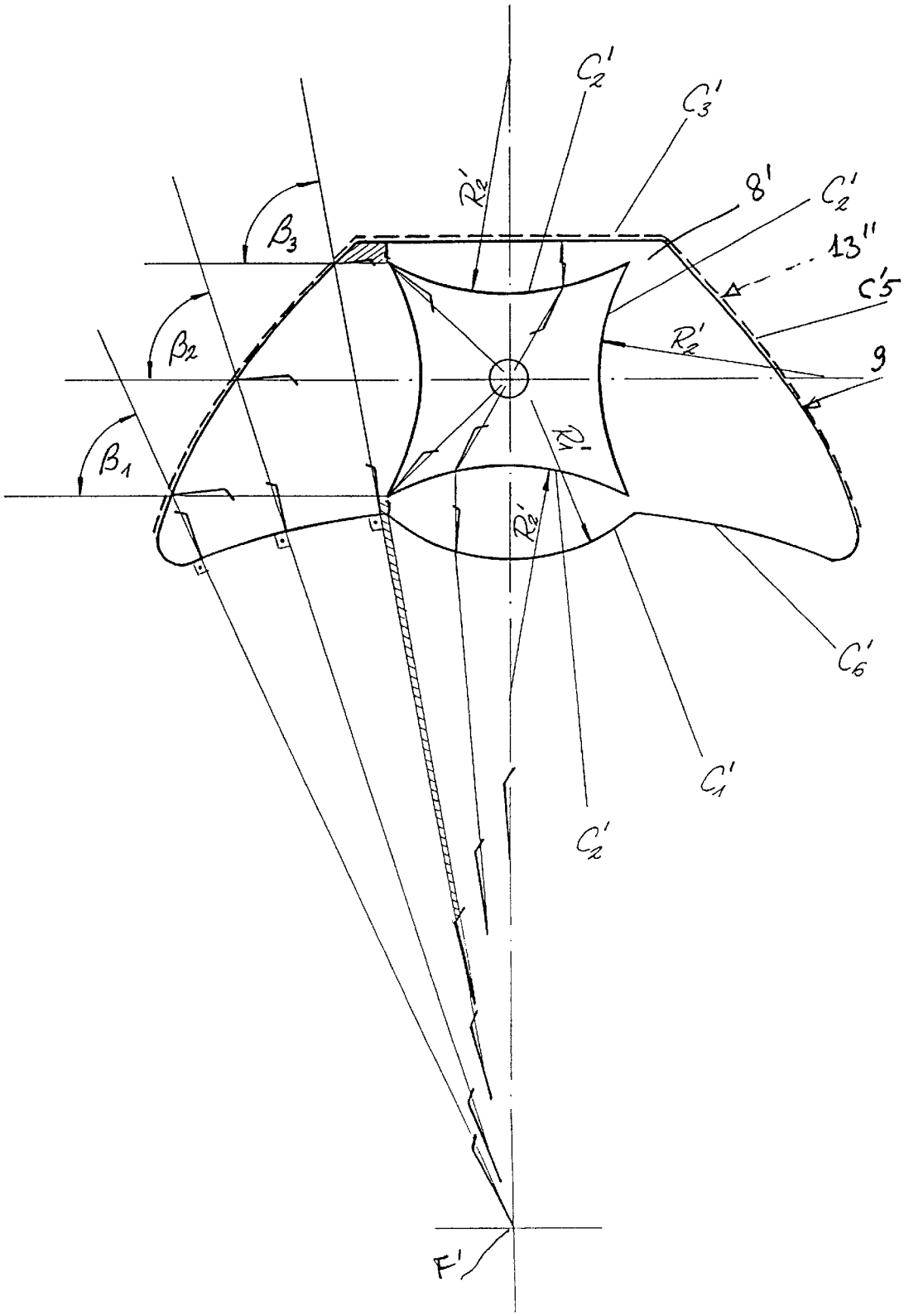

FIG. 4 is of the same type as FIG. 3 but $\beta\neq\alpha$ and $\beta 1<\beta 2<\beta 3<2\times 42°$ imposing a metallic reflection layer 13" over the whole external surface 9 of the upper wall 8' characterized at C'3 and C'5, with R'#R and therefore the curves C' of the figure different from the curves C of FIG. 3.

Figure 5:
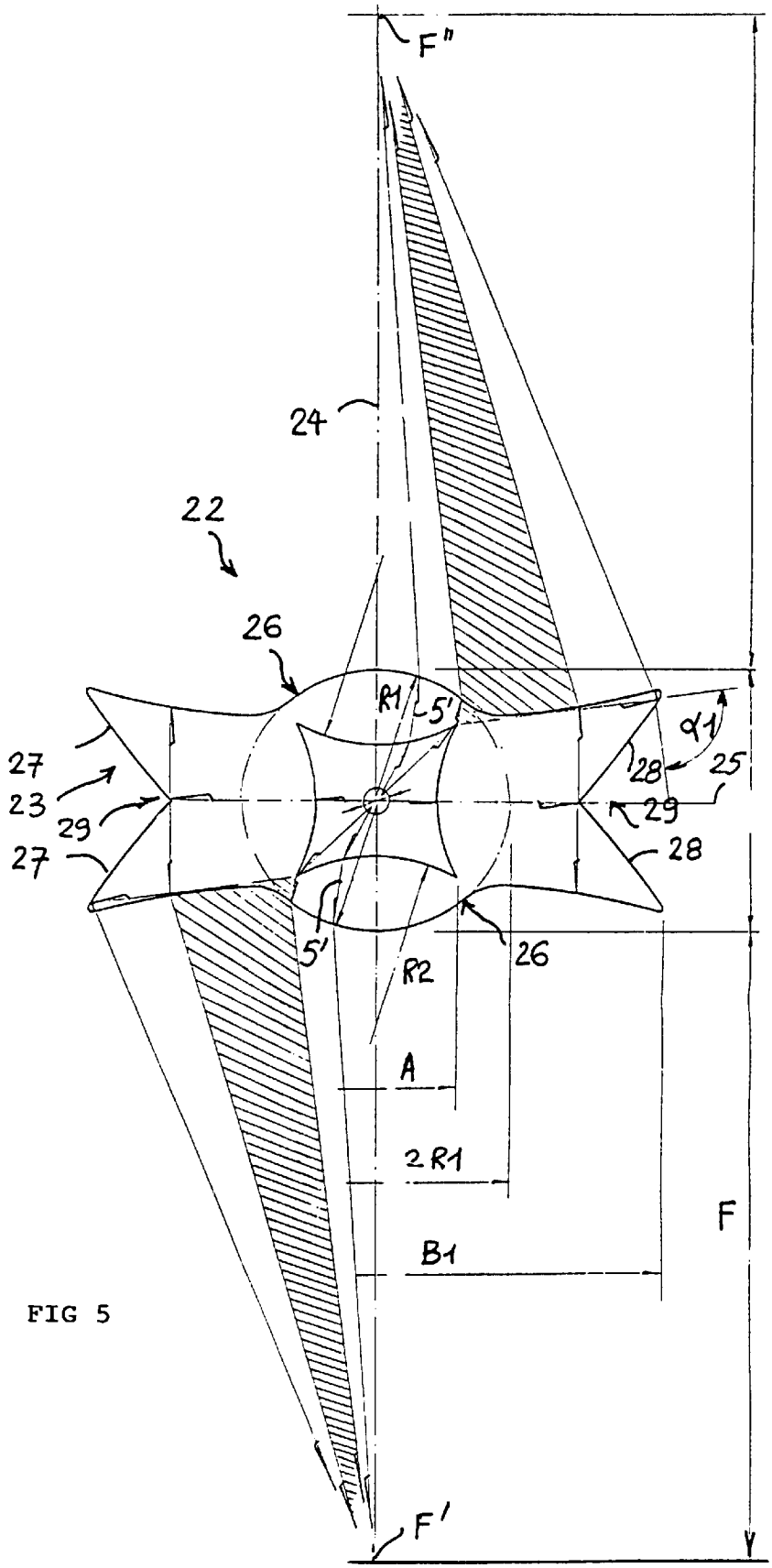
FIG. 5 shows another embodiment of the invention with a monoblock tube, of the head-to-tail type with respect to the axial plane of the bore parallel to the irradiation planes, and with two symmetrical or non-symmetrical virtual focal spots arranged at an angle of 180°.

FIG. 5 shows a monoblock emitter/reflector tube 22 called "head-to-tail" tube with two opposite irradiated virtual focal spots arranged according to an angle of 180°, F' and F", characterized in that the reflected radiation 5' never returns via the plasma focal spot.

The tube comprises two wings 23 symmetrical with respect to the perpendicular axial planes 24 and 25, and presents on each side an external face 26 of the type of that described with reference to FIGS. 1 and 2 and two reflecting surfaces 27 and 28 in the form of symmetrical portions of inverted parabola, forming an obtuse angle 29 between them.

In the same spirit as previously, there could be four opposite irradiated virtual focal spots at an angle of 90°, F', F", F'" and F"" (not represented).

Figure 6:
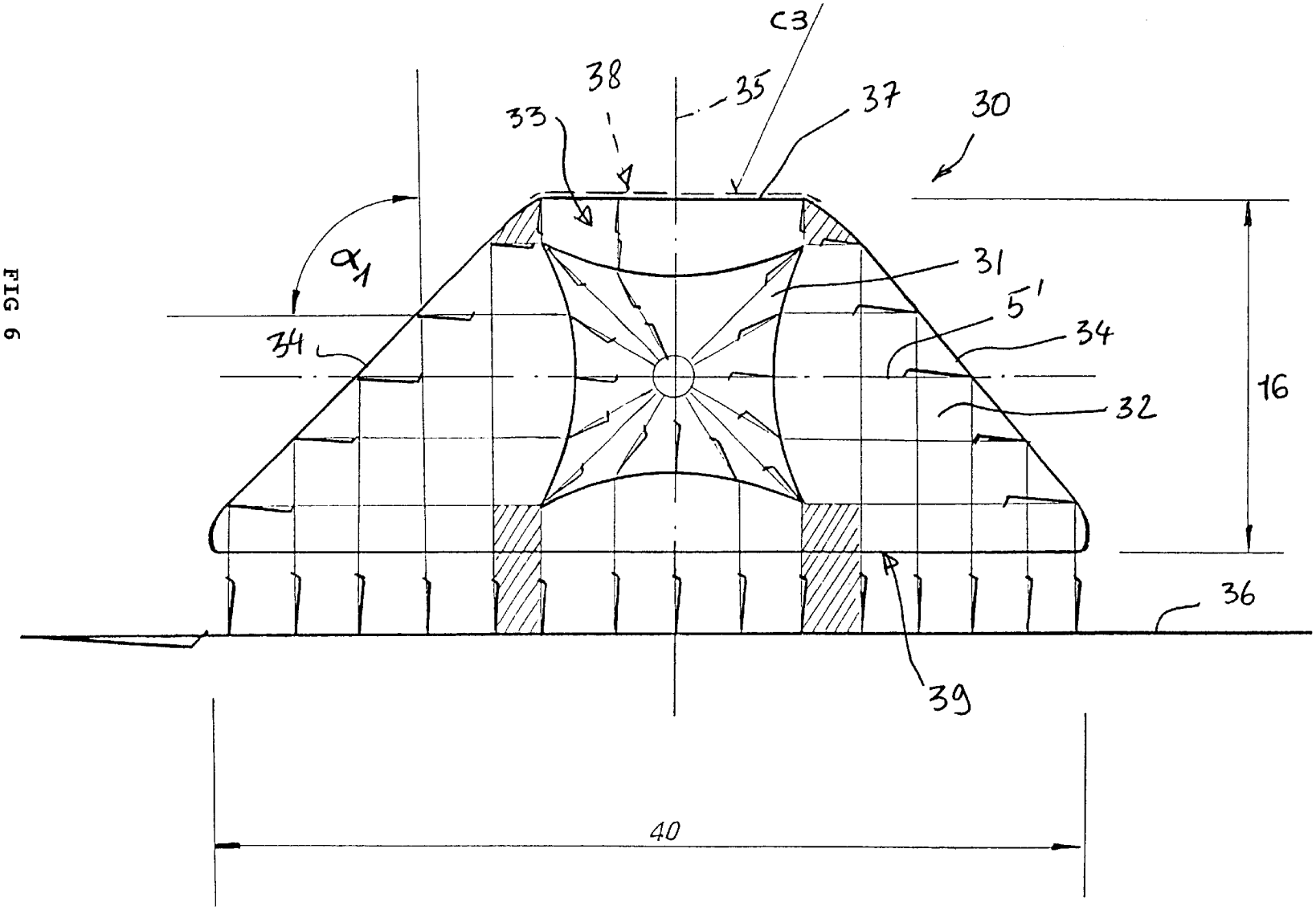
FIGS. 6 and 6A show cross sectional views of two other embodiments of the tube according to the invention provided with flat faces on each side of the bore.

In FIG. 6 a straight tube 30 has been represented with a bore 31 as described with reference to FIG. 1 and according to the embodiment of the invention more particularly described here.

The rays 5' pass here through the transparent solid medium 32 with strictly parallel flux. The tube 30 comprises an external upper face 33 comprising two surfaces 34 symmetrical with respect to the axial plane 35 perpendicular to the irradiated plane 36, of dioptric reflection, which surfaces are flat and inclined 45° with respect to the axial plane 35 in which $\alpha 1$ is equal to 90° (therefore $>2\times 4°$).

The upper face of the tube also comprises a flat, rectangular central part 37 covered by an inverted image reflecting layer 38, the bottom face 39 being flat, rectangular and parallel to the face 37 and to the plane 36 to be irradiated.

This type of embodiment of the monoblock emitter/reflector, with an incline of 45°, enables an irradiation by primary and secondary rays fully restituted perpendicularly or appreciably perpendicularly to the irradiated plane 36.

A monoblock emitter/reflector of the "flat iron" type is thus achieved enabling for example, in particular in the case of sterilization, solid or liquid irradiated planes 36 to be treated, these planes being able to be directly in contact with the radiating element, which is entirely new.

The curve C3 of the central part 37 is identical to that of FIG. 3 covered with a reflecting material. By modifications of the convex dioptric curves of the bore, the fluxes 5' passing through the solid transparent medium can be rendered slightly divergent, in such a way that $\alpha 1$ becomes $<2\times 42°$. In this case, a tolerance of more or less 5° in the divergence is accepted.

The external faces corresponding to the curves C3 and C5 of the previous figures, on the sides 34, are then provided completely covered with a reflecting layer, for example metallic, such as those represented in FIGS. 2 and 4.

Figure 6A:
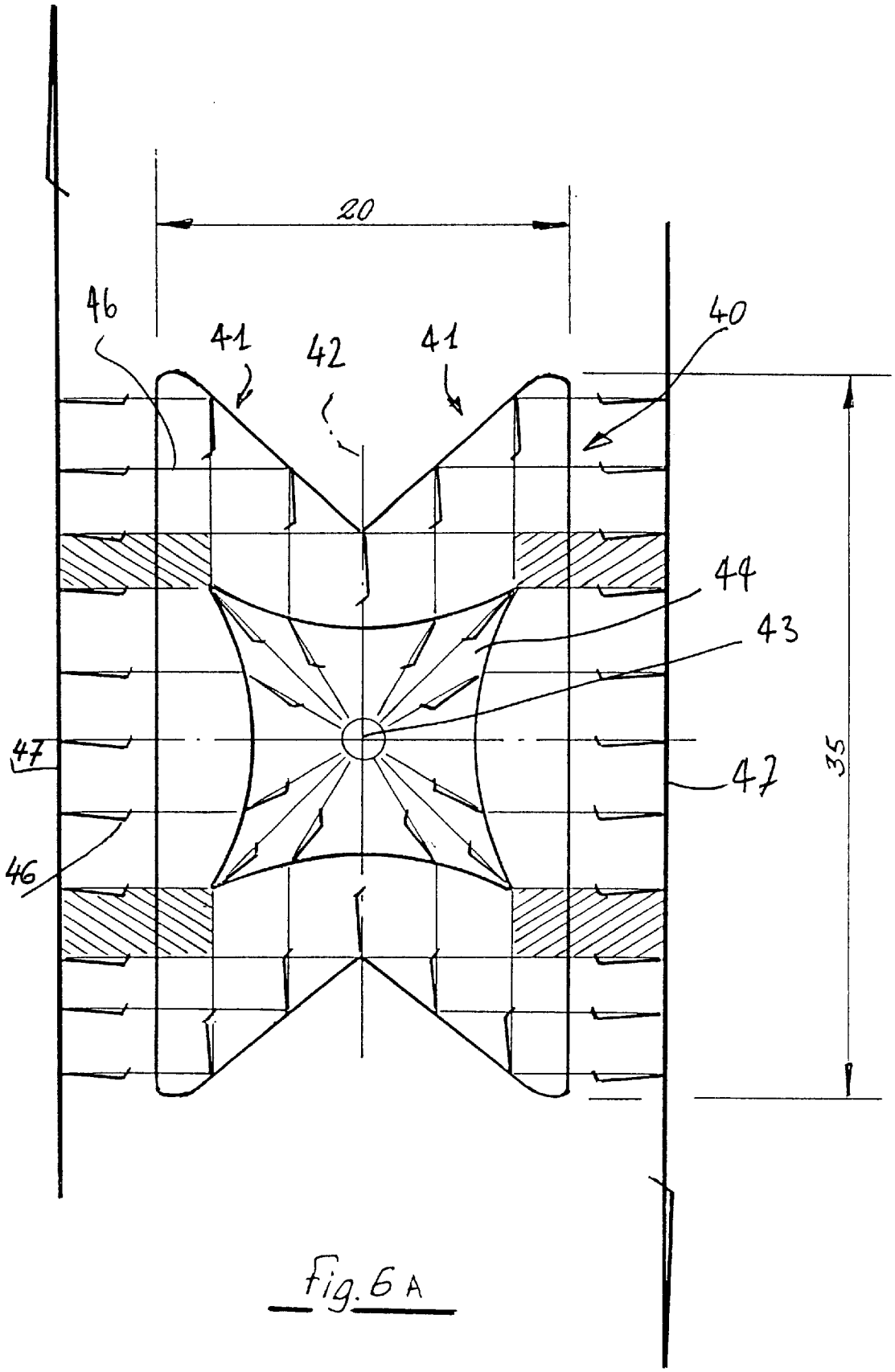

FIG. 6A is based on the same head-to-tail principle of design, construction and use as that of FIG. 5. The tube 40 comprises two identical parts 41, symmetrical with respect to the axial plane 42, centred on the geometrical centre 43 of the bore 44 with four convex sides of the type described in FIG. 1.

In the same spirit as previously, there could be four irradiating flat faces arranged at an angle of 90°. Such a device comprises four rectangular output planes, parallel two by two, enabling the irradiation planes 47 to be attacked perpendicularly with the rays 46.

Figure 7:
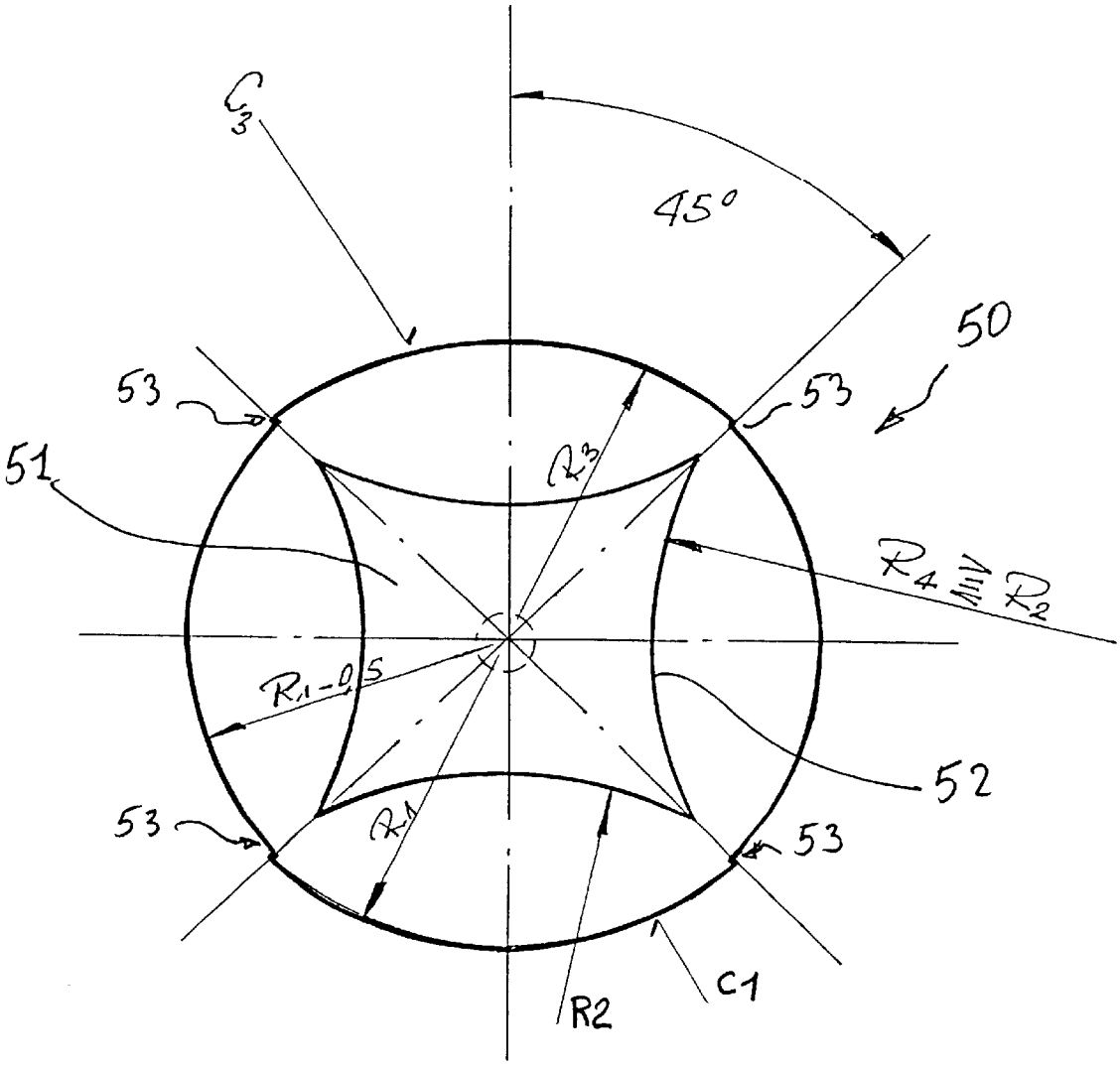
FIGS. 7, 8 and 9 are cross sectional views of other embodiments of the appreciably cylindrical tube according to the invention, without and with added-on wings, dissymmetrically or symmetrically.

FIG. 7 describes a tube 50, formed by extrusion, with a bore 51 with four convex faces 52 in the form of a portion of a cylinder of radii R2 and R4, with R2≦R4, or R4≧R2, as described with reference to the previous figures.

The external dioptric circle is "notched" on its periphery at 53 so as to receive (cf. FIGS. 8 and 9) right and left wing elements in the form of inverted parabolic curves 54 or flat parabolic curves at 45°, with a dioptric or metallic reflecting surface or on the same principle, head-to-tail wings 55 as described previously. The radius R3 can have an infinitely large dimension whose axial origin is at a distance and situated on the vertical axis, in such a way that the curve C3, initially formed by a portion of cylinder, then becomes a portion of plane characterizing the inverted light image.

Figure 9:
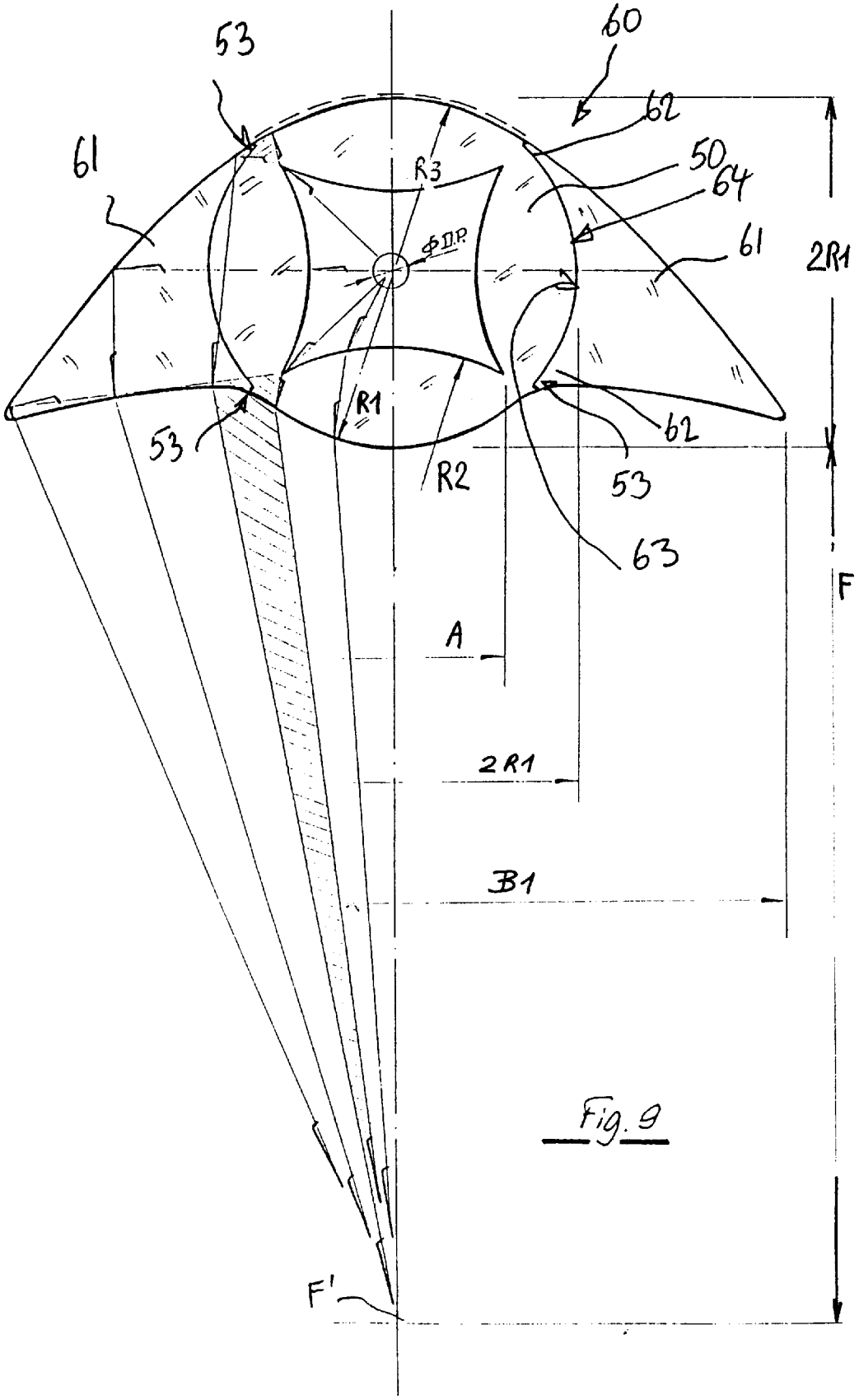

FIG. 9 shows a composite tube 50 possessing in all points the features and advantages of the monoblock tube of FIG. 1 and formed by assembly of the tube 50 of FIG. 7 with similar wings 61 to those described with reference to FIG. 1, which comprise ends 62 able to come into contact, cooperate and clip into the notches 53 of the tube 50, and an internal face 63 cooperating in contact and of complementary shape to the partially cylindrical external face 64 of the tube 50.

The advantage of such a construction lies in the achievement of a "virtually" monoblock emitter/reflector from a common trunk characterized by a tube of shape corresponding to FIG. 7 to which will be attached depending on the cases either the element 54 suitable for divergent or convergent fluxes or the element 55 suitable for the head-to-tail principle of FIGS. 5 and 6.

Figure 10:
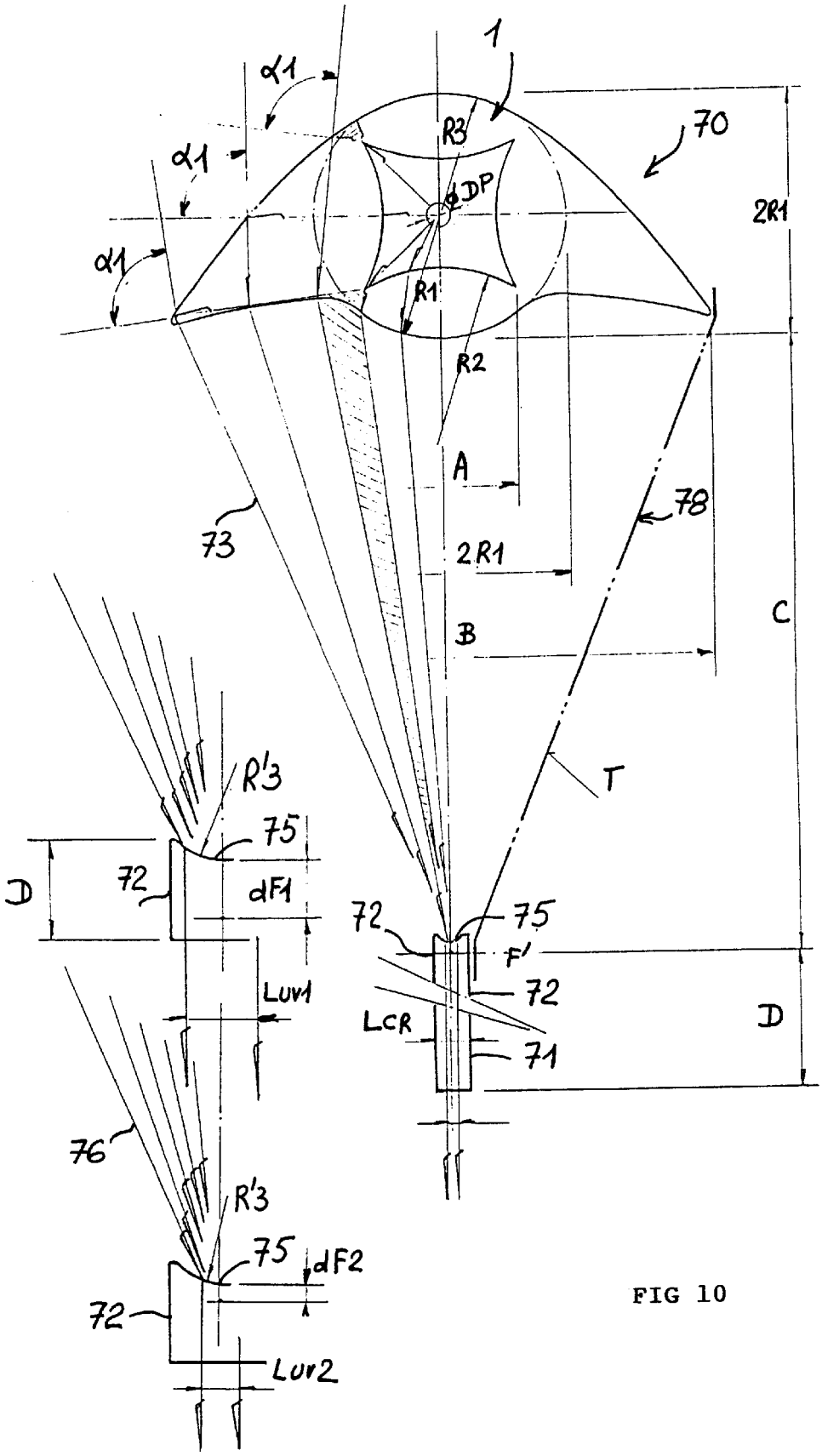
FIG. 10 is a cross sectional view of a device comprising the tube of FIG. 1 and a parallel flux rectifying blade with located at the focal spot, accompanied by partial enlarged scale views showing two positionings of the blade according to the focal spot.

FIG. 10 shows a device 70 comprising a tube 1 identical to that described with reference to FIG. 1, and a transparent blade element or blade 71 with parallel side faces 72.

Such a device presents the following advantages:

- high power density of the focused rays obtained by focusing the radiation 73 of an inverted parabolic system,
- focused rays rendered perpendicular in compliance with the teaching of Lambert's law by the blade element 71, called radiating collector or "R.C".

The transparent blade 71 of thickness Lcr has on the upper edge 75 a concave shape of radius of curvature R'3 and situated at a distance dF1 with respect to the virtual focal spot F', in such a way that the rays 76 reaching this concave dioptric plane are rectified into a parallel radiating flux represented in the drawing by the width Luv.

The blade 71, or radiating collector, can have a length D comprised between a few millimetres and several meters, in straight or curved manner, conducting the light flux in the thickness according to the same method and the same quality of restitution of the light performances as those of optic fibre.

The blade 71 has on the bottom surface 77 an edge machined according to three shapes:

- either straight-cut to pass through the dioptric plane without being diverted,
- or machined of concave shape to be output as a divergent flux,
- or machined of concave shape to be output as a convergent flux.

It can moreover be noted that there is a single distance dF1 associated to the concave shape of identical radius R3 which enables a refracted radiation in the transparent solid medium of the CR, according to a strictly parallel flux.

Any variation of dF1 results in a divergence or a convergence of the flux which will remain channelled between the internal dioptric walls, corresponding to the side faces 72, of the transparent blade 71 so long as the first limit ray incident to these same walls does not exceed the value of 42° for λ=360 nm.

The mechanical variation of dF1 in fact causes a power density variation and therefore even more so a power variation. A power variator with constant wavelength is thus obtained.

The mechanical link between the monoblock emitter/reflector and the radiating collector can for example be achieved by two metal plates 78, or reference T, represented by a mixed bold line in FIG. 10.

Figure 11:
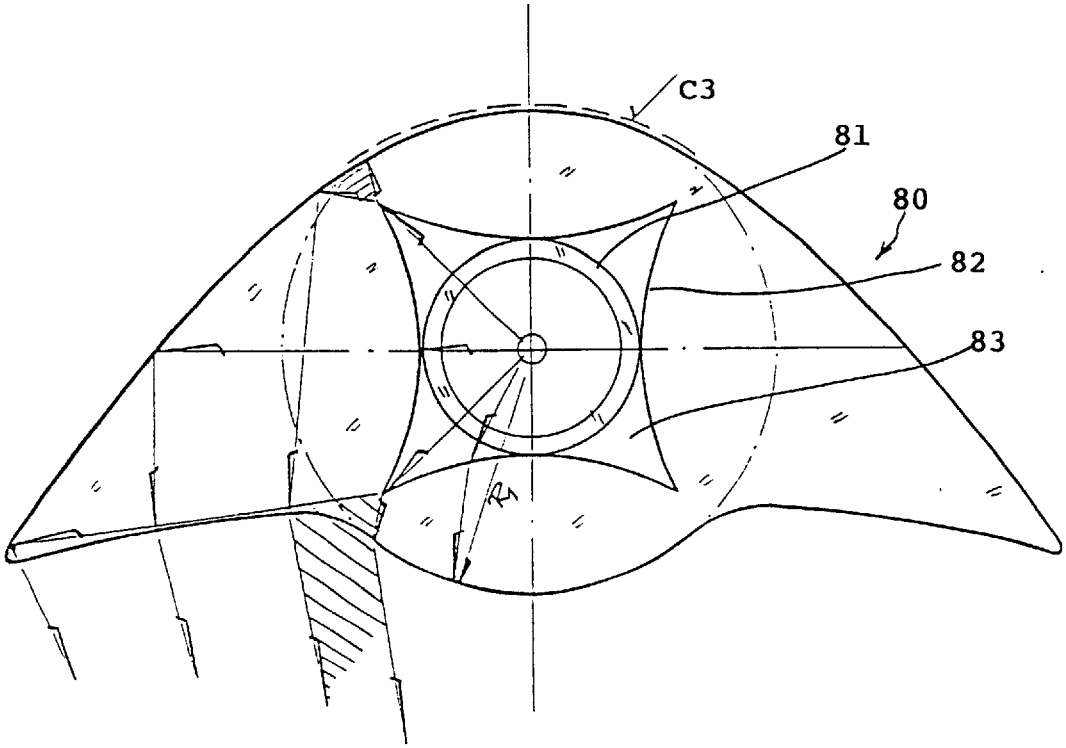
FIGS. 11 and 12 are cross sectional views of an alternative version of another embodiment of the tube according to the invention of FIG. 1, comprising a second cylindrical radiation-emitting tube internal to the bore of a tube which is either monoblock or formed by four elements assembled to be similar to a monoblock, said second tube being able to be centred by contact on the generating lines of the four convex curves, or centred without contact.
Figure 12:
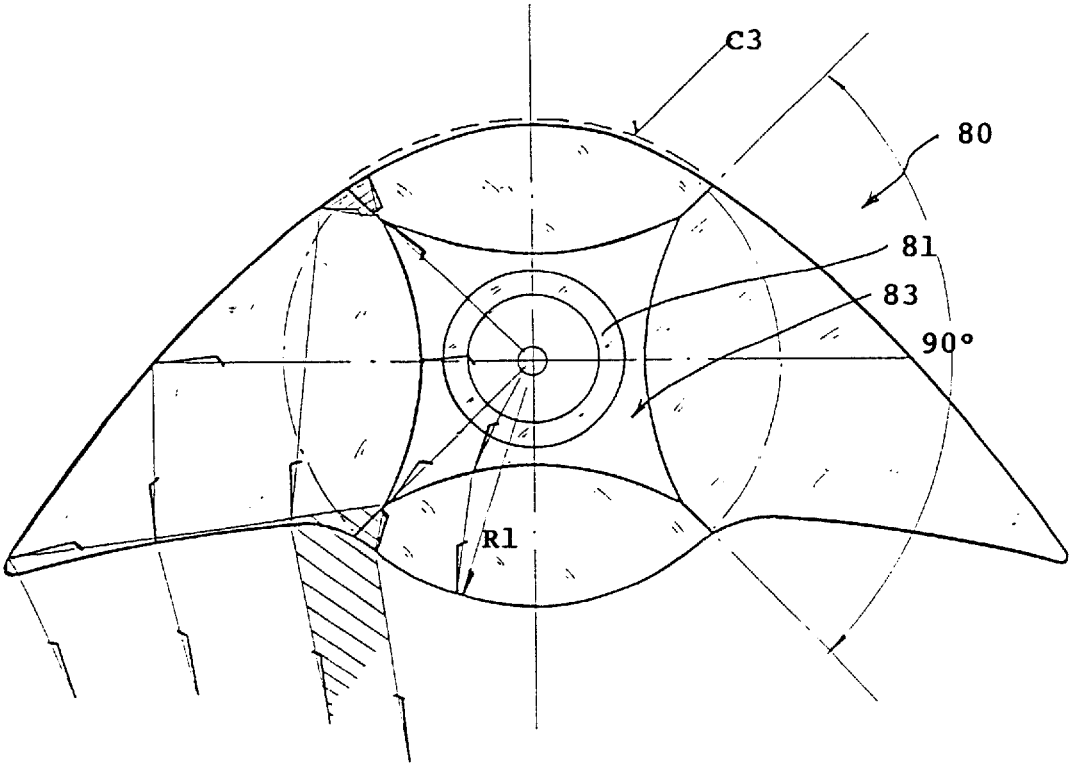

FIGS. 11 and 12 show a tube 80 of a shape corresponding to the embodiment described in FIG. 1.

Inside the tube of the conventional shape of the monoblock, drawn in a single element for FIG. 11 and in several elements for FIG. 12, there is provided a cylindrical, ultraviolet, and/or visible, and/or infrared emitting tube 81, the external diameter of whose cylindrical quartz enclosure is:

- either of almost identical dimension to the minimum distance between the convex curves 82 of the bore 83 (cf. FIG. 11), with which it is tangent,
- or of smaller dimension than this same distance (cf., FIG. 12), in which case means for securing and centring the tube 81 in the bore are provided in a manner known in itself (not represented), or as described previously as far as the example of a coolant flowing in the free space 83 between the external tube 80 and the internal tube 81 is concerned for which the weight of the enclosure of the internal tube per unit length would be equal or appreciably equal to the buoyancy.

Figure 13:
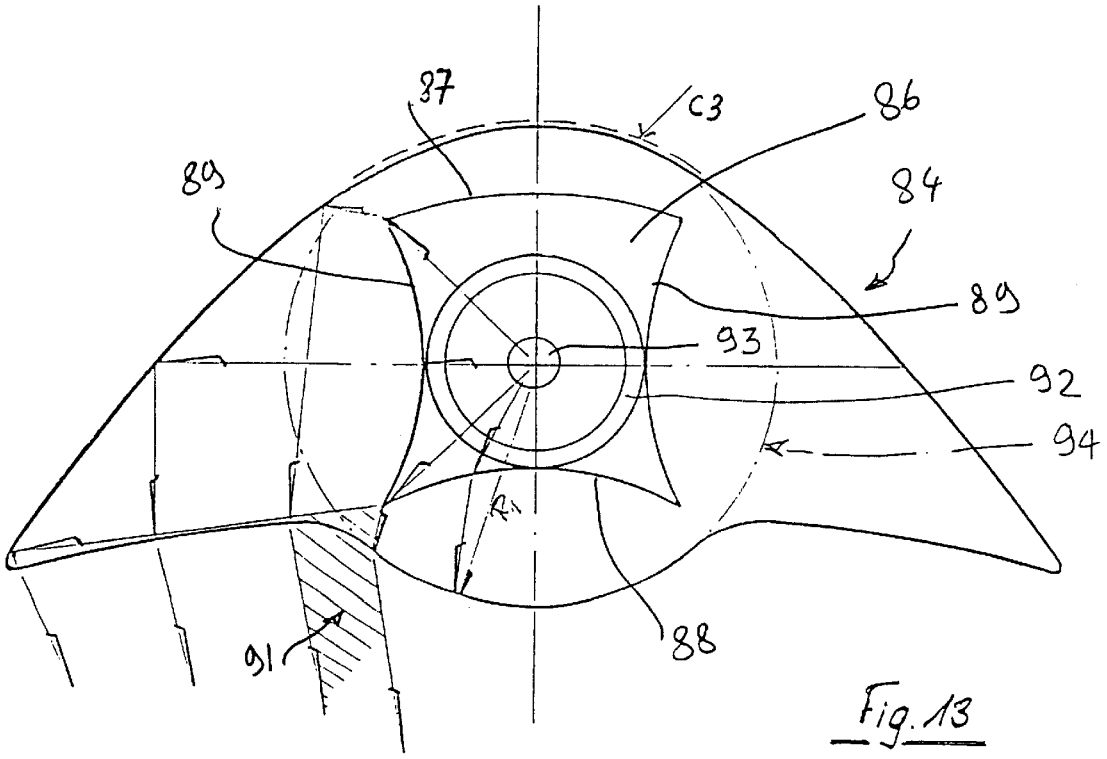
FIGS. 13 and 14 are cross sectional views of another embodiment of the tube according to the invention with a bore comprising a concave upper face.
Figure 14:
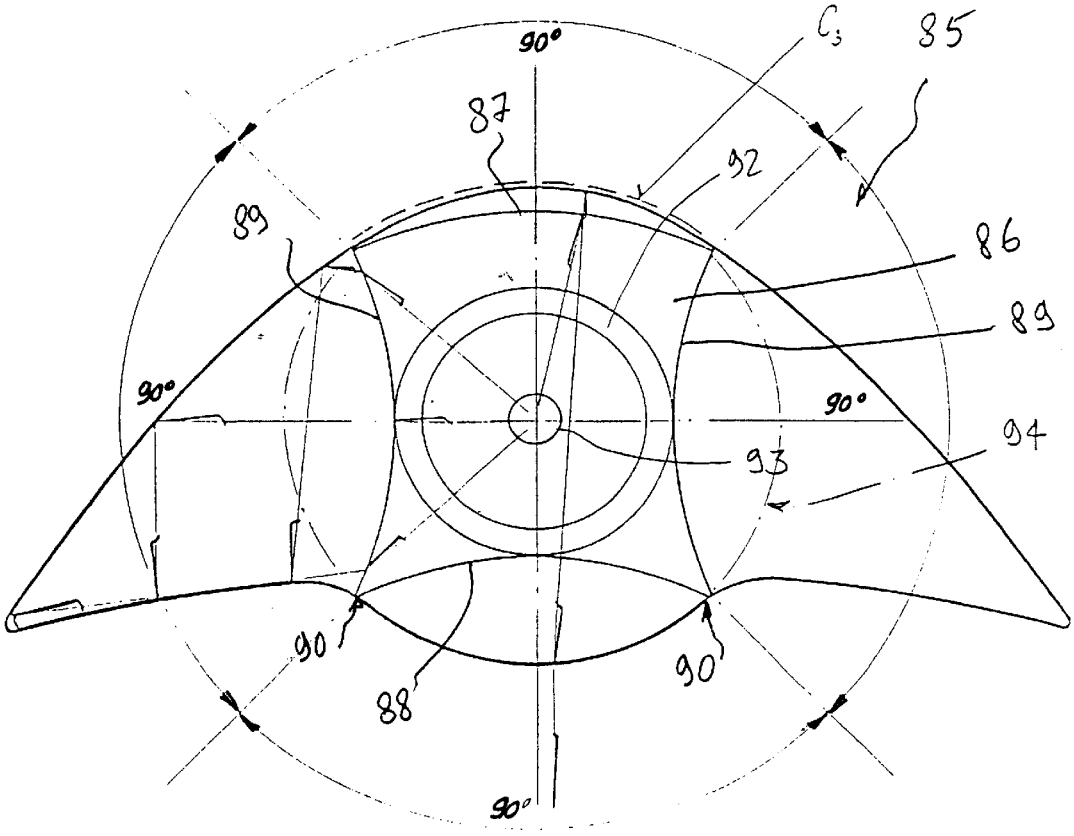

FIGS. 13 and 14 show tubes 84 and 85 of the same external shape as that of the tubes represented in FIGS. 11 and 12, suitable for a different shape of bore 86 comprising a concave upper edge 87, of cylindrical shape but inverted with respect to that of the other three identical convex sides 88 and 89.

The radii of curvature of the concave upper face 87 and lower convex face 88 are for example identical, the sides 89 being identical.

In the embodiment of FIG. 14, the ends 90 of the bore are tangent to the surfaces of the upper and lower faces, which eliminates the dead zones 91 (cf. FIG. 13) represented in hatched lines in the figures.

The tubes 84 and 85 comprise in addition a transparent cylindrical internal glass tube 92 which enables the emitting beam 93 to be centred in the geometrical centre of the cylinder 94 (in mixed line in the figures).

Naturally and in the same way, these configurations of an ultraviolet or infrared ray emitter with an internal tube with a bore of conventional cylindrical shape are presented according to the same principle, for the shapes of FIGS. 3, 4, 5, 6 and 6A.

Figure 8:
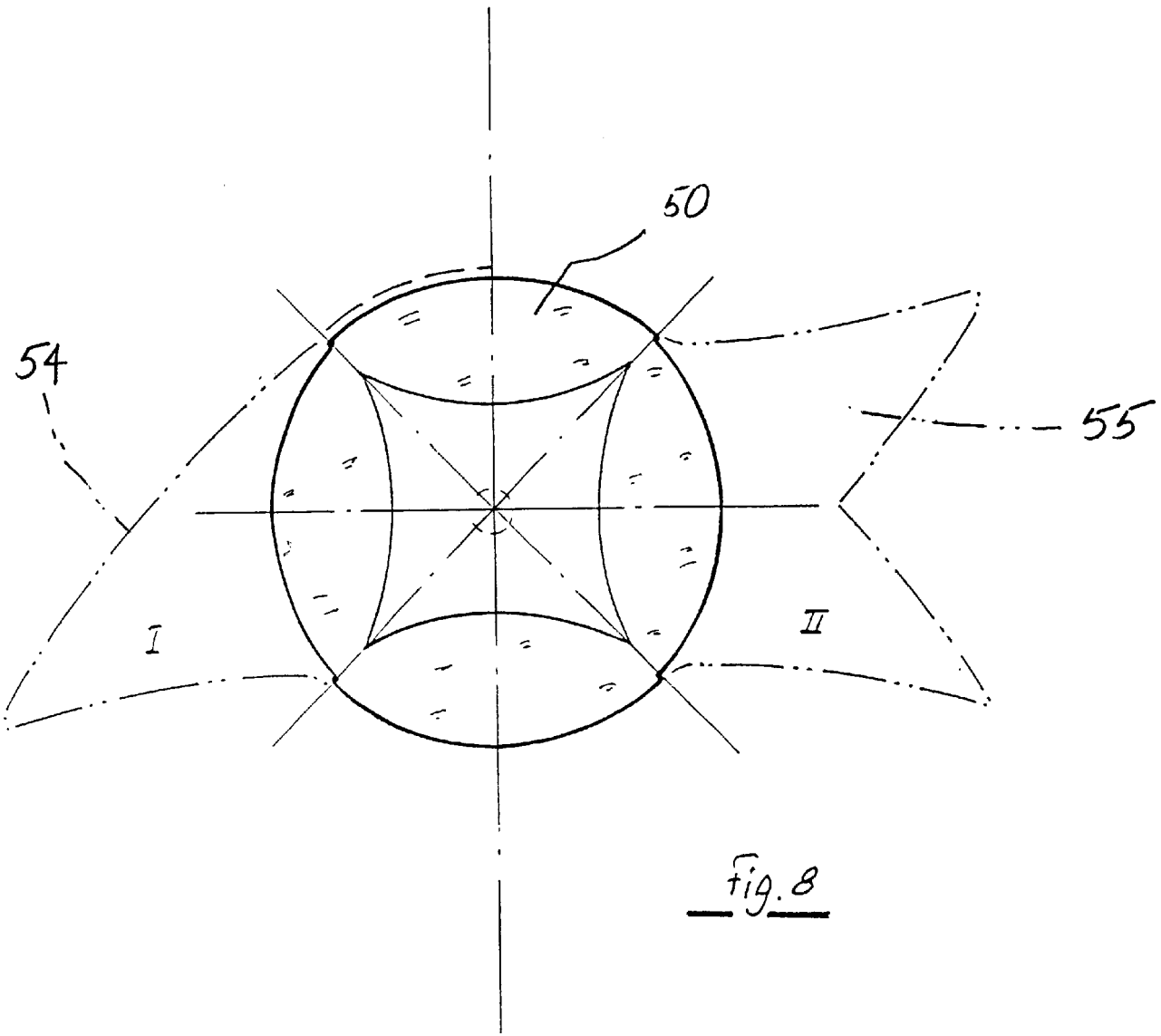
Figure 15:
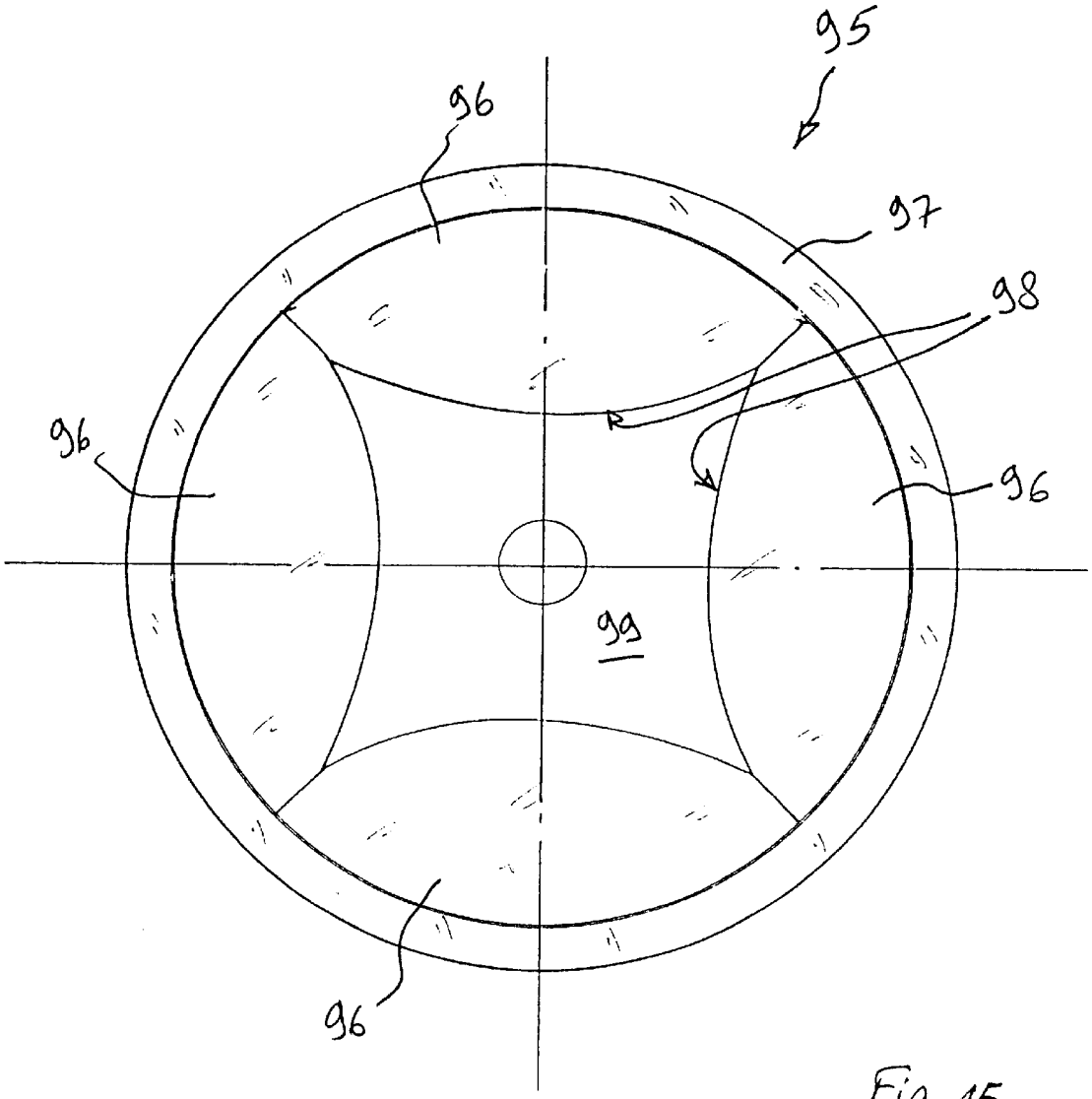
FIGS. 15 and 15A show another embodiment of a tube according to the invention with a bore formed by four quarters in the form of biconvex longitudinal lenses housed in a cylindrical tube.
Figure 15A:
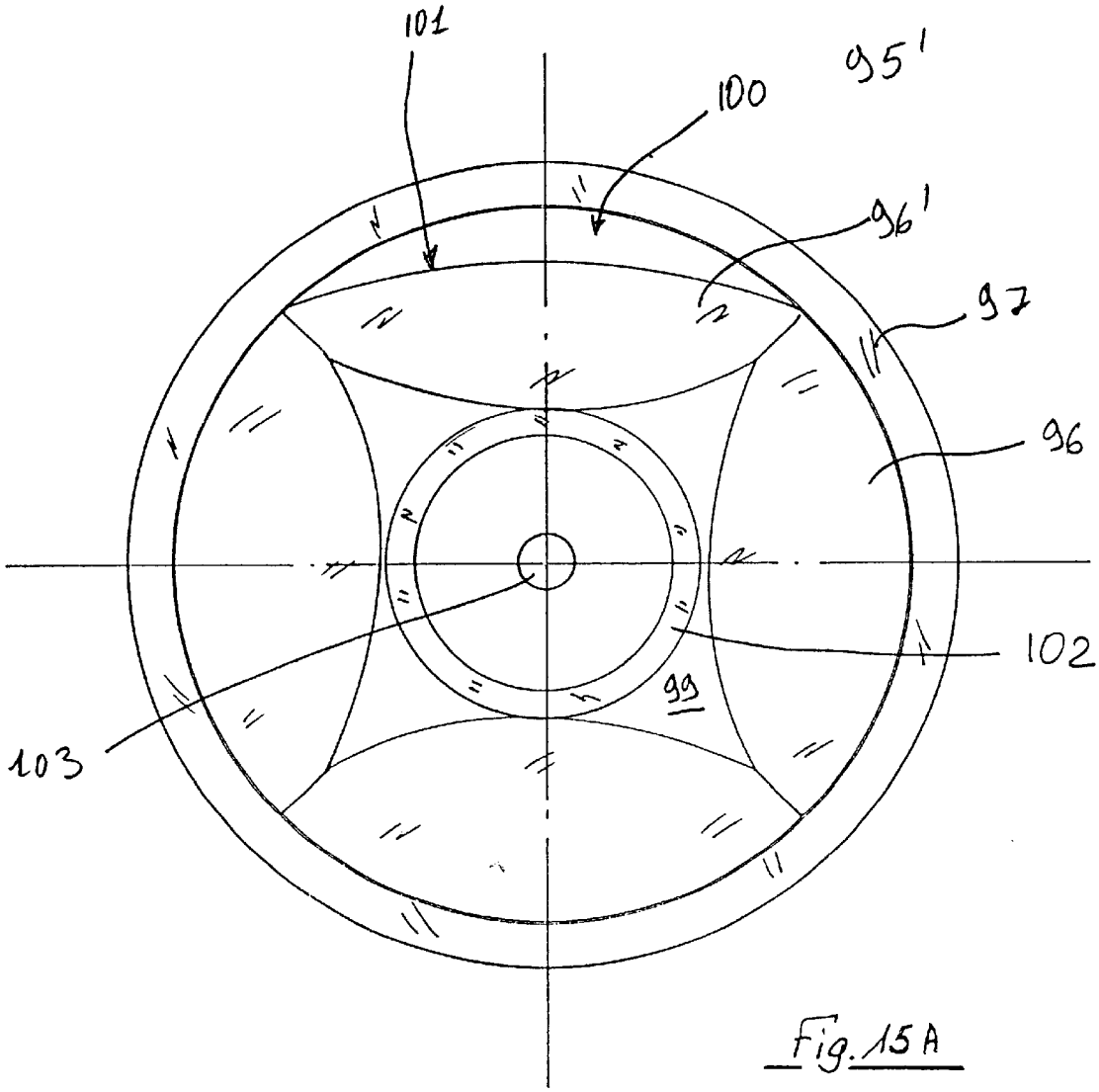

In FIGS. 15 and 15A a tube. 95, 95' has been represented formed by four biconvex lenses 96, 96', inserted in a quartz tube 97 of cylindrical or appreciably cylindrical external shape according to FIGS. 7 and 8.

Each lens 96 presents an external surface of complementary shape to that of the cylindrical internal face of the tube 97, and is arranged in contact to form with its convex internal part 98 the bore 99 according to the invention.

A lens 96' can be smaller (cf. FIG. 15A) and leave a dioptric space 100 between its convex external face 101 and the internal face of the tube 97.

The tube 95' of FIG. 15A also comprises an internal cylindrical plasma retention tube 102 centred on its axis, as described previously.

Figure 16:
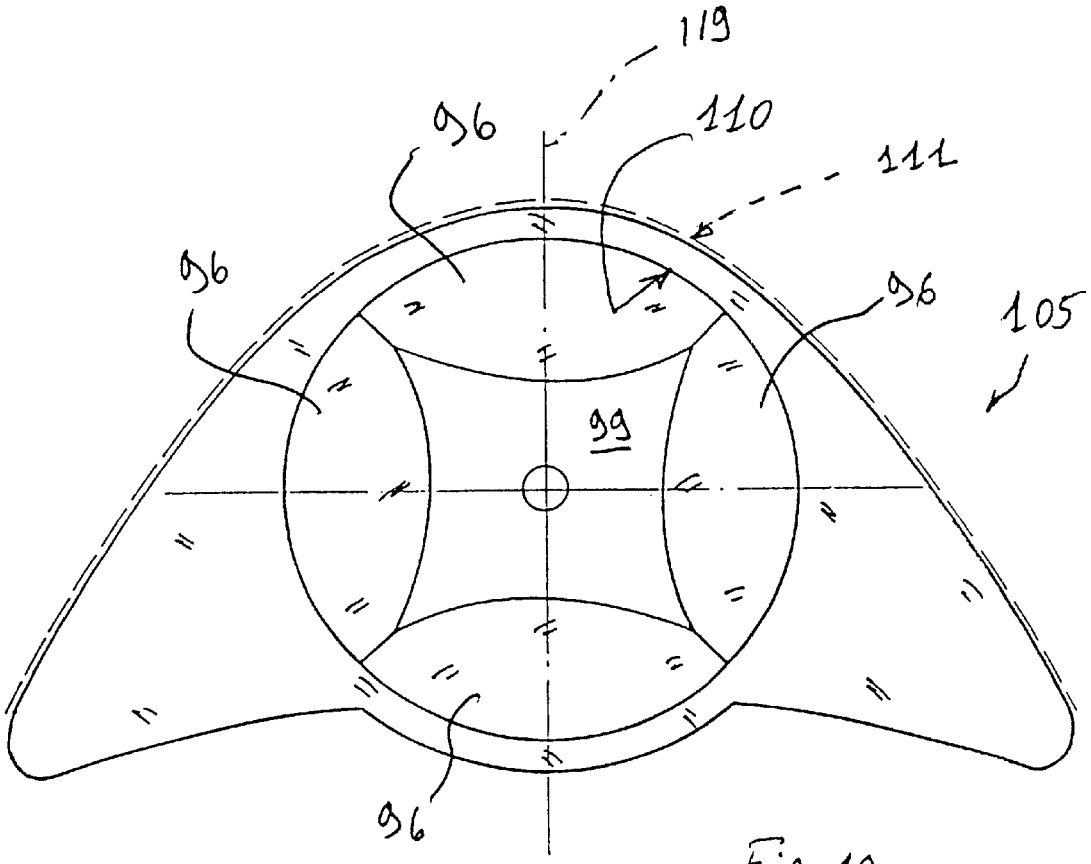
FIG. 16 is a cross sectional view of another alternative version of a tube according to the invention of the type represented in FIGS. 1 and 2, the bore being formed by assembly of biconvex lenses.

FIG. 16 shows a tube 105 based on the same principle of formation of the bore, with an emitter/reflector with wings, of monoblock form, with or without an internal tube 102.

More precisely, the tube comprises a cylindrical bore 110 equipped with the four biconvex elements 96 as previously described to form the star-shaped bore 99 with four branches.

Figure 17:
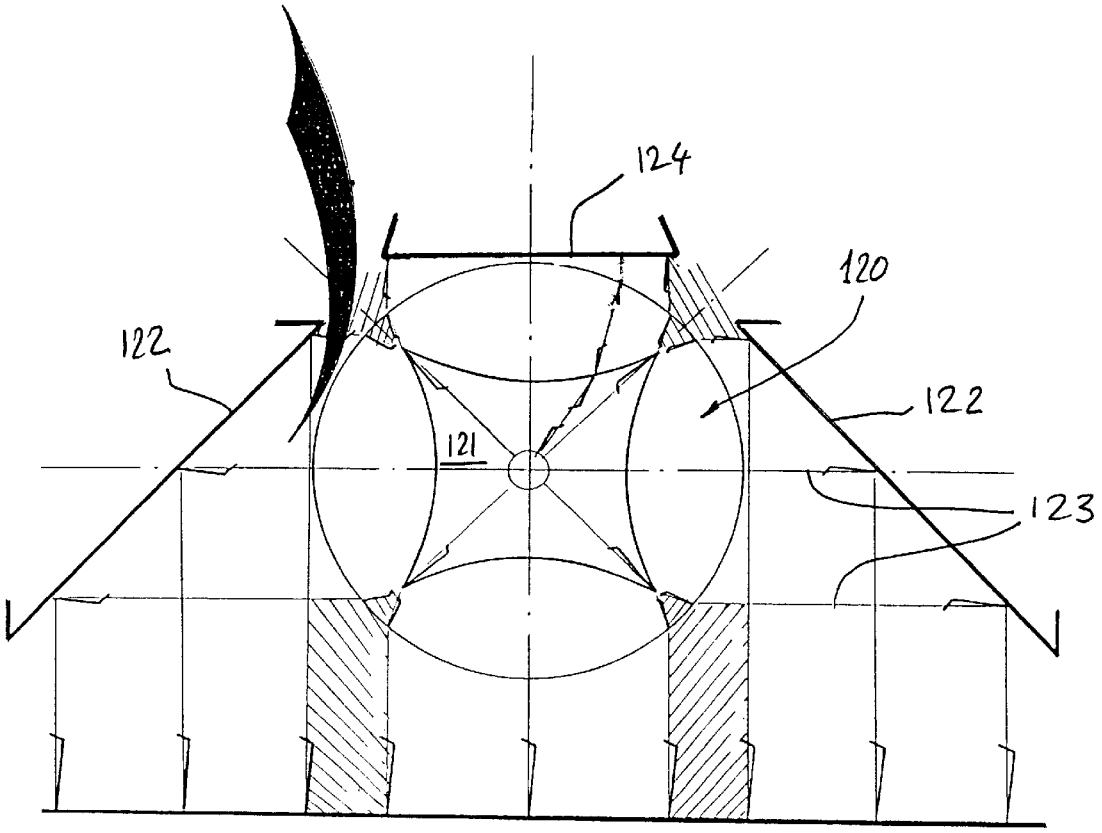
FIGS. 17 to 20 are schematic cross sectional views of several embodiments of a device according to the invention with a tube of appreciably cylindrical shape and lateral reflecting walls dissociated from the tube, of flat shape or in the form of a portion of inverted parabolic cross section.
Figure 18:
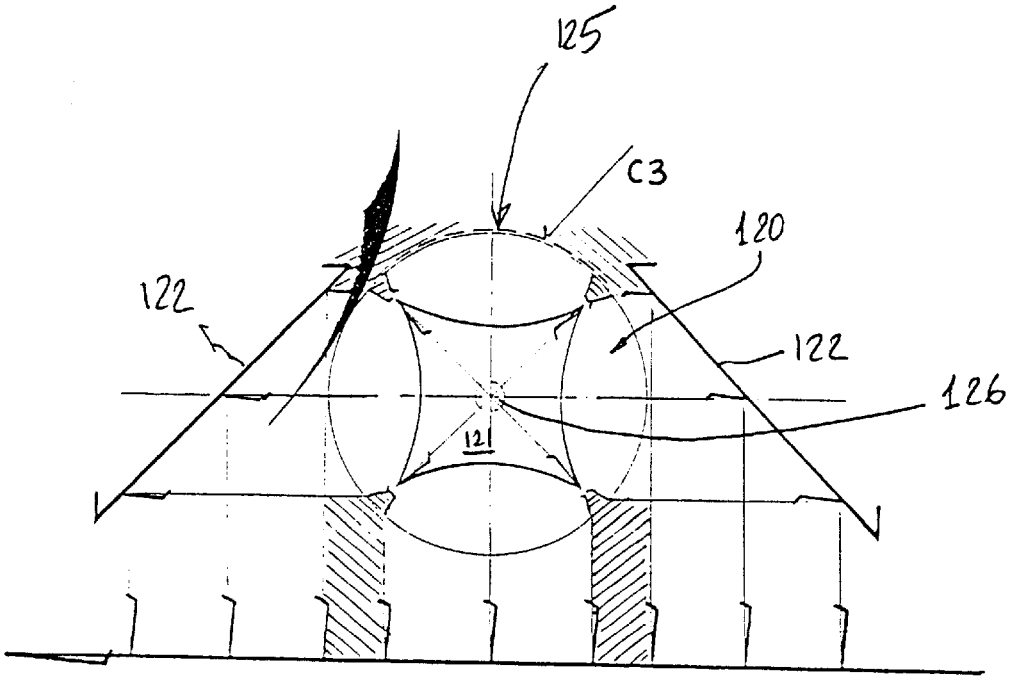
Figure 19:
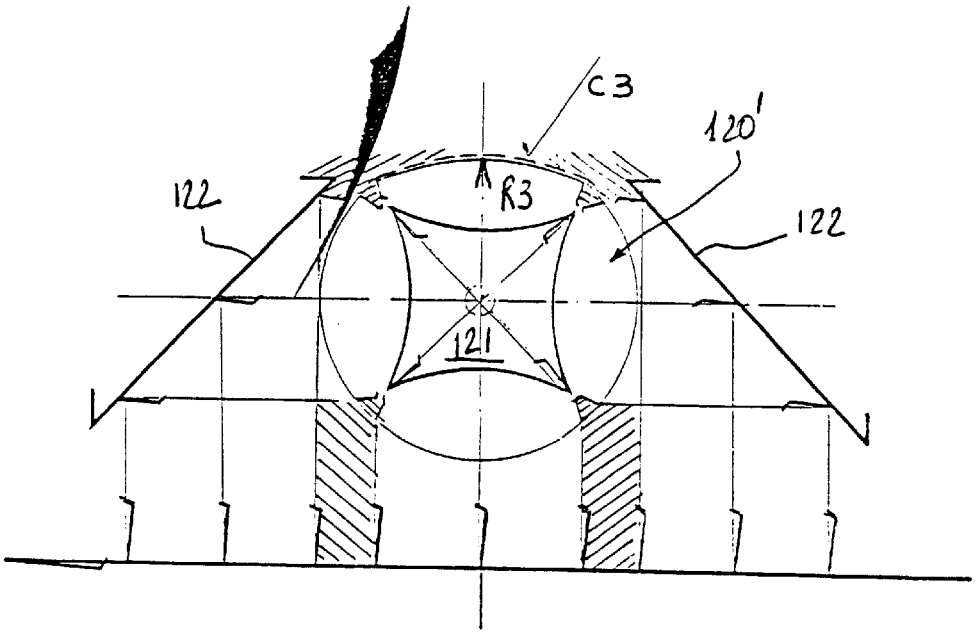

FIGS. 17 to 19 show a monoblock emitter 120 or 120' with a symmetrical star-shaped bore 121 with four convex walls.

The tubes 120 present a shape of circular cross section and the tube 120' flattened on the top with a large radius of curvature associated with flat reflecting walls 122 at 45°. The curve C3 becomes a plane when the radius R3 tends to infinity.

The radiation passes through the transparent solid medium with a flux of divergent form, the value of the angle of divergence of which is compatible with the dioptric refraction curve of the external cylinder, in such a way that the refracted rays 123 form a parallel flux output from the tube 120.

Such an arrangement is in fact equivalent to providing convex walls of the bore arranged to make the radiation flux parallel in the mass of the glass, reflected towards the plane to be irradiated by the walls themselves of said tube as described previously.

Thus the cylindrical emitter associated to two symmetrical, flat reflecting faces 122, inclined at 45°, gives an irradiating light effect identical to that of the best parabolic reflector, at low manufacturing cost.

Furthermore, a flat horizontal metal plate 124 or a metallization C3 (FIG. 17) is provided on the external upper face (cf. FIG. 19) enabling the inverted light image effect to be obtained.

On the contrary, the tube 120 of FIG. 18 presents an upper face 125 covered with a film, of curved shape, of metallization C3, which enables a return of the reflected radiation elsewhere than on the focal spot of emission 126.

In FIGS. 17 to 19, advantage is taken of the zones where radiation is absent to arrange openings between the reflectors 122 enabling an air flow to pass between the emitter and reflector without loss of radiation.

Figure 20:
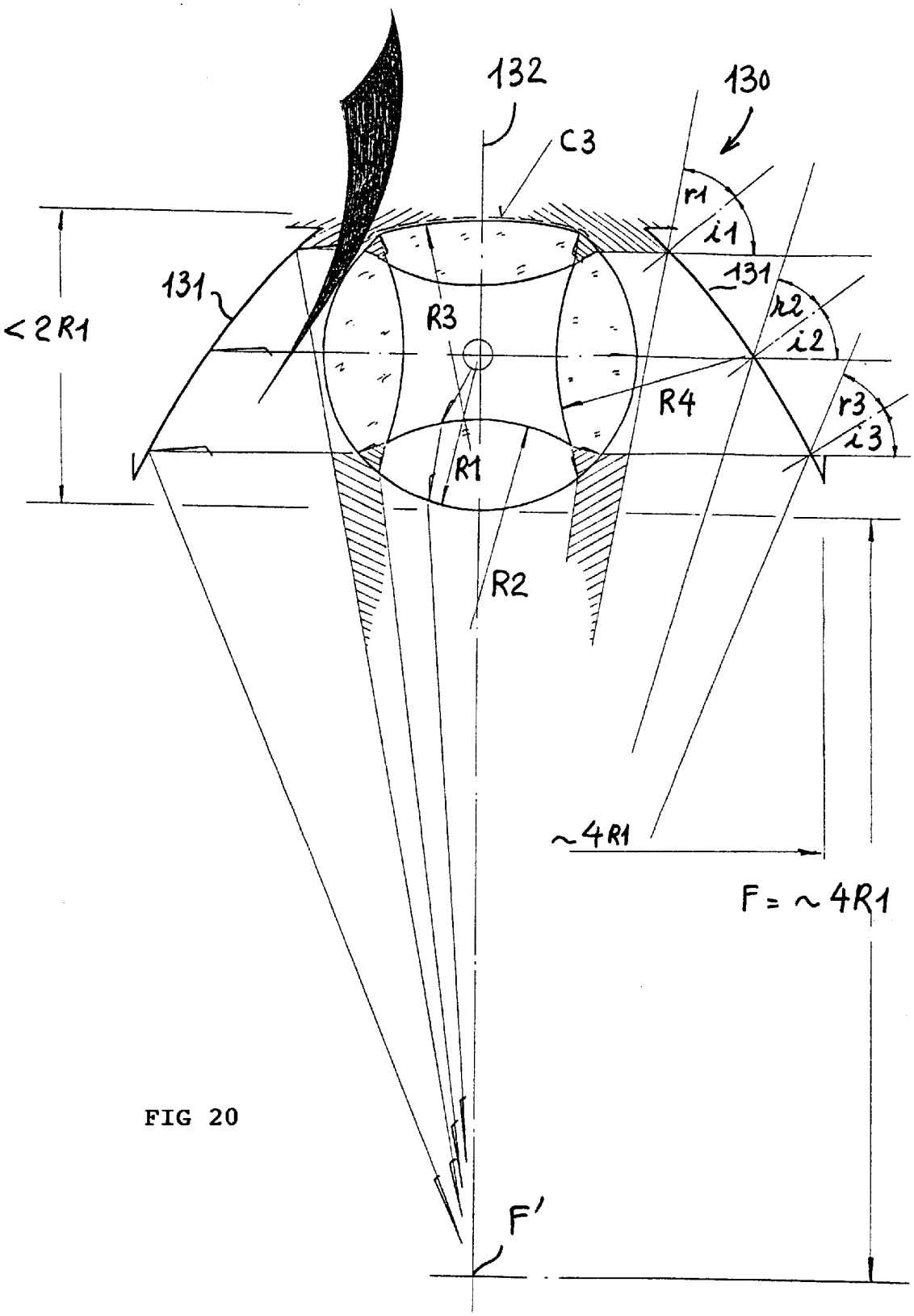

FIG. 20 shows a tube 130 similar to that of FIG. 19 with two metal plates 131 extending longitudinally along the tube, symmetrical with respect to the axial plane 132, in the form of inverted parabolas, the radii of curvature being such that the all of the primary and secondary rays are located at the irradiated virtual focal spot F'.

Thus the convex curves of the bore modify the divergent radiating flux from the focal spot situated in the gaseous plasma medium by a parallel or appreciably parallel flux in the solid transparent quartz medium.

The effect resulting more generally from the reflector with an elliptic or parabolic curve is obtained from reflection curves whose mathematical shape, as a reflector, is therefore new.

It is from an emission with parallel (and no longer divergent) flux that an inverted parabolic shape of a dioptric or metallic surface reflecting the secondary radiation will be achieved, with a convergent flux replacing the usual ellipse.

Thus all of the primary and secondary rays are located on the homogeneous and focused irradiated focal spot in the case of FIGS. 1, 2, 3 and 4.

Likewise it is from an emission with parallel (and no longer divergent) flux that a shape of a plane inclined at 45° of a dioptric or metallic surface reflecting the secondary radiation will be achieved, with a parallel flux replacing the usual parabola. Thus the whole of the primary and secondary rays reach the irradiated plane in homogeneous, parallel and perpendicular manner, in the case of FIGS. 6 and 6A.

In a general manner the following is obtained in the transparent solid medium:

- for the fluxes corresponding to the primary radiations, appreciably parallel rays,
- and, for fluxes corresponding to the secondary radiations, parallel rays.

This is achieved by adjusting the radii of curvature of the opposite high and low convex dioptric curves C2 different from the opposite right and left dioptric curves C4.

It is in this way (cf. FIG. 1) that appropriate correction of the dioptric planes passed through at C1 and C6 achieves the convergent flux focused at F' according to FIGS. 1 to 5 or the parallel flux perpendicular to the plane according to FIGS. 6 and 6A.

Finally, it can be noted that in certain figures shaded zones exist created by diversion of the refracted rays whose existence can be used to advantage with the invention according to the embodiment more particularly described here:

- either to position four electrical conductors able to create, depending on the cases, a magnetic field or a capacitive effect around the plasma which will even further foster its concentration at the geometric focal spot and will help achieve a faster ignition of the lamp arc,
- or to act as a fixing point for mechanical supports in the case of emitters of great lengths,
- or to achieve a longitudinal aeraulic distribution with a neutral gas or cooling air for example,
- or to create by extrusion, on the one hand two quartz parts at the top (shield side) and bottom (primary radiation side), and on the other hand a single (left and right) quartz part as has been seen with reference to FIGS. 12 and 14.

The quartz tube according to the invention can also be achieved from a tube inside which biconvex lenses are slid to then achieve assemblies as shown in FIGS. 15 and 16.

The fixings of the emitting tube assembly, spacers in the form of convex lens and external housing, are for their part simple to achieve.

At each end of the radiation emitter, behind the electrode, the different quartz parts can in fact either be hot crimped or soldered, or sealing be performed by means of a refractory ceramic paste, or more simply a mechanical fixing can be performed.

Naturally, and as set out above, the present invention is moreover in no way limited to the embodiments more particularly described herein, but on the contrary extends to encompass all alternative embodiments thereof, and in particular those where the cross section of the luminous disk is even smaller.

Advantageously the voltage per line length has a value greater than or equal to 50 volts/cm, and advantageously more than or equal to 100 volts/cm.

Even more advantageously, a plasma bundle length greater than 1 m 50 and a voltage per line length of more than 20 volts/cm are associated in combination.

In an advantageous embodiment, the radius of the cross section of the cylindrical plasma bundle with respect to the diameter d of the circle inscribed at the peaks of the bore is such that $\frac{1}{100}d \leqq r \leqq \frac{1}{2}d$, for example $\frac{1}{50}d \leqq r \leqq \frac{1}{4}d$ or $\frac{1}{8}d$, $r \leqq \frac{1}{10}d$, and/or $r \geqq \frac{1}{20}d$.

The invention also relates to apparatuses which enable in particular sterilization of water, either for the reflector with inverted parabola around an axis, or in the form of a flat sheet for the reflector with 45° plane, and drying of ink and varnish to be polymerized onto products which are wire-based or circular around an axis, such as marking of electrical wires, cables, rubber pipes, PVC tubes, etc.

Thus, an ultraviolet emitter/reflector according to the invention can be fitted on a sterilization or polymerization chamber for example, in opposition around a transparent cylinder acting as sterilization or polymerization chamber, or also and for example in opposition on each side of a sheet of liquid contained between the two transparent walls formed by the flat faces of the flat emitter/reflector thus achieving a sterilization chamber.

What is claimed is:

1. A tube for emitting electromagnetic radiation, made of a transparent non-fluorescent material, in particular a glass-based or quart-based material, and having a straight structure drilled from end to end by a bore elongate around an axis, confining a housing designed to contain a radiation-emitting filament or plasma bundle, characterized in that the bore is of appreciably square or rectangular shaped cross section having four sides of which are in the shape of convex curves, said sides forming dioptric surfaces arranged to modify the direction of the rays emitted from the filament or from the axis of the emitting bundle to make them parallel or appreciably parallel in the transparent solid medium of the glass.

2. The tube according to claim 1, characterized in that said sides arranged to form dioptric surfaces so as, in combination with the output dioptric surface of the tube or with a reflecting surface associated with the output dioptric surface of the tube, to direct the rays in a parallel or convergent flux towards a surface or a line to be irradiated.

3. The tube according to claim 1, characterized in that the convex shape of the internal walls of the bore is a portion of a circle.

4. The tube according to claim 1, characterized in that it comprises an upper external wall, called the upper face, of external surface arranged to reflect the emitted rays back towards the axis of the bore, said external wall being covered with a reflecting material.

5. The tube according to claim 1, characterized in that it comprises a reflecting surface securedly united to said tube.

6. The tube according to claim 5, characterized in that it is provided with a reflecting surface for reflection of the emitted rays situated on one side of said tube, a surface comprising two longitudinal side wings symmetrical with respect to an axial plane of the bore, the portion of reflecting surface of said side wings being inscribed in a surface of straight or inverted parabolic or appreciably straight or inverted parabolic cross section.

7. The tube according to claim 6, characterized in that the reflecting surface is formed at least partly by the internal faces of the wings, by dioptric refraction.

8. The tube according to claim 6, characterized in that the reflecting surface is formed at least partly by a reflecting material.

9. The tube according to claim 6, characterized in that the tube comprises an external face joining the ends of the wings, called the bottom face, situated on the opposite side from the generating line at the peak of the tube with respect to the bore, convex at the centre, and appreciably straight at the ends, according to a curve symmetrical with respect to the axial plane containing the generating line at the peak, said bottom face being arranged to direct the emitted rays towards the axial plane of the bore, towards a focalization line situated on the irradiation plane.

10. The tube according to claim 9, characterized in that it is symmetrical with respect to an axial plane of the bore parallel to the irradiation plane.

11. The tube according to claim 6, characterized in that the upper face of the tube is partially cylindrical on the side where the generating line at the peak of the tube is located between the external faces of the side wings.

12. The tube according to claim 6, characterized in that the upper face of the tube is truncated forming a flat external face between the external faces of the side wings.

13. The tube according to claim 1, characterized in that it is of appreciably cylindrical shape.

14. The tube according to claim 13, characterized in that it comprises two added-on glass wings, symmetrical or not with respect to the axial plane of the bore perpendicular to the irradiation plane.

15. The tube according to claim 1, characterized in that the bore is formed by four radially distributed glass quarters adjoined via their ends and engaging in a peripheral glass cylinder or a cylindrical bore made in the tube.

16. The tube according to claim 1, characterized in that it comprises a second cylindrical tube internal to the bore and designed to contain the plasma bundle and/or containing an emitting filament.

17. The tube according to claim 16, characterized in that it comprises an intermediate space arranged between the internal tube and the external tube to allow flow of a gaseous or liquid coolant.

18. The tube according to claim 13, characterized in that the bore comprises an upper surface of concave cross section.

19. The tube according to claim 18, characterized in that it comprises electrode chambers of internal cross section greater than or equal to the internal cross section of the radiation-emitting part of the tube.

20. The tube according to claim 1, characterized in that the bore is arranged to contain an ionized gas excited at variable frequencies, the rays emitted being of the ultraviolet, and/or visible, and/or infrared type.

21. The tube according to claim 1, characterized in that it comprises a filament emitting infrared radiation.

22. An electromagnetic radiation emitter/reflector device comprising a straight glass tube according to claim 1.

23. The device according to claim 22, characterized in that it comprises on the focal plane of concentration of the emitted rays, a blade with parallel or appreciably parallel side faces in the form of a funnel, comprising a dioptric radiation input surface able to transform the convergent rays received into a parallel radiation flux.

24. The device according to either claim 22, characterized in that it comprises reflecting surfaces separated from the tube and constituted by reflecting plates.

25. The device according to claim 24, characterized in that the plates are flat.

26. A process for application of radiation to a product in sheet form or disposed on a flat or curved surface, characterized in that the product is irradiated with a radiation-emitting element presenting a very small cylindrical or appreciably cylindrical cross section with a radius centered in the bore of a straight glass tube, elongate around an axis, said bore being of appreciably square or rectangular shaped cross section having four opposite sides of which are in the form of convex curves, said sides forming dioptric surfaces arranged to modify the direction of the rays emitted from the axis of the bore to make them parallel or appreciably parallel in the transparent solid medium of the glass, before being diverted to the product by reflecting surfaces.

27. The process according to claim 26, characterized in that the emitting element is a tubular plasma bundle of ultraviolet, and/or visible, and/or infrared rays.

28. The process according to claim 27, characterized in that the tubular plasma bundle of ultraviolet, and/or visible, and/or infrared photon rays is of a cross section presenting a maximum radial dimension smaller than or equal to about 4 mm.

29. The process according to claim 26, characterized in that the emitter is an electrical filament, emitting infrared rays.

30. The process according to claim 26, characterized in that at least two irradiation planes are irradiated with a single tube, said planes being situated symmetrically on each side of said radiation-emitting tube.

* * * * *